US006048175A

United States Patent [19]

Corlew et al.

[11] Patent Number: 6,048,175

[45] Date of Patent: Apr. 11, 2000

[54] MULTI-WELL COMPUTERIZED CONTROL OF FLUID PUMPING

[76] Inventors: Edward A. Corlew, 100 Green Meadow Dr., Hendersonville, Tenn. 37075; Henry B. Steen, III, 1714 Erie Way., Bowling Green, Ky. 62084; John W. Smith, 5005 Hammit Road, Bowling Green, Ky. 42102

[21] Appl. No.: 09/160,615

[22] Filed: Sep. 24, 1998

Related U.S. Application Data

[60] Provisional application No. 60/059,931, Sep. 24, 1997.

[51] Int. Cl.[7] ..... F04B 17/00

[52] U.S. Cl. ..... 417/120; 417/141; 417/142; 417/143; 417/139

[58] Field of Search ..... 417/120, 139, 417/141, 142, 143

[56] References Cited

U.S. PATENT DOCUMENTS 5,074,758 12/1991 McIntyre ..... 417/139
5,193,985 3/1993 Escue et al. ..... 417/53

FOREIGN PATENT DOCUMENTS 842-228 7/1981 U.S.S.R. ..... 417/120

*Primary Examiner*—Charles G. Freay
*Assistant Examiner*—Cheryl J. Tyler
*Attorney, Agent, or Firm*—Sheldon H. Parker

[57] ABSTRACT

A system for controlling one or more borehole pumps to enable pumping-on-demand is described. The system uses a computerized controller which, in combination with sensors, monitors and controls the activity of the pump, thereby controlling fluid in the borehole. The system is continually in one of three modes, the monitoring mode, the pump mode, and the recovery mode. Within each cycle of modes, the system performs multiple checks on the apparatus involved. The data obtained during the check is stored in appropriate databases as well as checked against predetermined norms. In the event of a malfunction within the apparatus, or other supervised and/or monitored functions, the system can activate a notification system, such as a centralized monitoring facility. A pump is disclosed with a fluid sensor to detect the presence of fluid and transmit this presence to the computerized monitoring system. A slug sensor notifies the computer of the beginning and end of a predetermined quantity of fluid. An exterior housing with a lightning protector can be placed over the borehole to contain the monitoring computer and associated read outs. At least one shunt valve is affixed along the propellant and return lines inline to accommodate accumulation of fluid. A receiver/separator tank has a separator member to separate the gas from the fluid.

19 Claims, 14 Drawing Sheets

MULTI-WELL COMPUTERIZED CONTROL OF FLUID PUMPING

This application claims the benefit of U.S. Provisional No. 60/059,931, filed Sep. 24, 1997.

BACKGROUND OF THE INVENTION

1. Field of the Invention

The disclosed invention relates to the computerized control of a pumping system that permits automatic monitoring and subsequent on demand removal of fluids.

2. Brief Description of the Prior Art

Several different pumps are available to pump oil and water. The most widely used method for pumping oil is by using a pump jack (beam pump) connected to rods and tubings. Methods using air to propel fluids to the surface are airlift pumps, compressed air centrifugal pumps, and air pumps which require pressures sufficient to overcome the hydrostatic head of the fluid in the hole.

Pump jacks are relatively expensive, bulky, and because of the weight of the unit, a crane or hoist is necessary when the unit is installed, removed, and serviced. Usually, these units are powered by electric motors, and the efficiency of lifting oil by this unit in the field is very low, usually less than one percent.

The air lift system is simple in use, but it depends on the relative densities of fluid and/or air-fluid mixture and for deeper wells, the required pressure and volume of air is quite large. In addition, the air in this system often emulsifies the oil. A typical airlift system is described in U.S. Pat. No. 759,706. Anthony et al. U.S. Pat. No. 4,092,087 also discusses a very complicated air operated pump, where compressed gas or air in the range of 25–350 PSI is utilized with a large float to cause the pump to force the fluid up a tube. This complicated construction is obviously quite expensive.

Air pumps have been designed such that the fluid passes through a ball valve located on the bottom of the pump tank. U.S. Pat. No. 919,416 to Boulicault and Japanese Pat. No. 5681299 by Nakayama discuss such a system with an air tube connected to the top of the tank and a fluid discharge tube extending to the bottom of the tank. After the tank fills with fluid flowing through the bottom ball valve, air pressure is applied to the air tube which closes the bottom valve and forces the contents of the fluid up the discharge tube. If the fluid level is several hundred feet or more above the pump, considerable air pressure is necessary to overcome the hydrostatic level of the fluid to close the bottom valve and even greater pressure is required to force the fluid to the surface. McLean et al U.S. Pat. No. 3,647,319 employs a similar method with the addition of a ball valve in the fluid discharge tube to prevent the fluid in the discharge line from returning to pump tank. This unit requires rather large air pressure to elevate fluid from deeper wells. In column 3 of their patent, they state that full discharge will occur from any depth within range of 0 to 300 feet. At a depth of 1,000 feet below the top of the fluid, a pressure of about 460 PSI and a large air volume will be required to discharge water from that borehole.

Although progress has been made in the apparatus to pump oil or water from a borehole, the systems generally operate on a timed basis, pumping whether or not oil or water is present. This places increased wear on the apparatus as well as uses valuable energy. The prior art systems require a pumper to visit onsite to verify that the system is working properly. Further, prior art systems have not provided the safety measures that are important to protect our environment. The instant disclosure provides a computerized system that controls and monitors the pumping and storage apparatus of multiple wells to provide on demand pumping. The monitoring capabilities further provide safety features that help to prevent oil leaks or thefts, while using minimal running energy.

SUMMARY OF THE INVENTION

The invention discloses a system for controlling one or more borehole pumps to enable pumping-on-demand. The system uses a computerized controller which, in combination with sensors, monitors and controls the activity of the pump, thereby controlling fluid in the borehole. The system is continually in one of three modes. The majority of the time the system is in Mode One, the monitoring mode, during which the system is waiting for fluid to be detected, or some other appropriate initiator occurs. Once the initiator, such as a fluid, is detected by the system, the controller will start Mode Two, the initiation of the pump cycle. Mode Two, the pump mode, begins with the application of propellant gas and ends when the fluid slug is detected at the surface, signaling the controller to terminate the application of the propellant gas. At this time, the controller enters a system recovery period, or Mode Three. This recovery period allows time for the propellant gas pressure to be recharged, pump chamber pressure to equalize with the bore hole pressure, the chamber to recharge with bore hole fluid, and time for the down-hole sensor, if employed, to stabilize.

Within each cycle of modes, the system performs multiple checks on the apparatus involved. The data obtained during the check is stored in appropriate databases as well as checked against predetermined norms. In the event of a malfunction within the apparatus, or other supervised and/or monitored functions, the system can activate a notification system, such as a centralized monitoring facility.

The pump disclosed for use within the system comprises a pumping chamber and a U-shaped chamber proximate one end of the pumping chamber. A valve system extends from the pumping chamber into the U-shaped chamber. The valve system is a hollow polygon having at least one valve seat containing a valve passage. A check ball blocks the valve passage during the pumping mode and permits fluid to flow into the pump chamber during the monitoring mode. The U-shaped chamber contains fluid inlets to enable fluid to enter the U-shaped chamber and flow through the valve passage into the pumping chamber. A propellant line is affixed to the pumping chamber to provide access for propellant to enter the chamber and push the fluid out through a fluid return line. The fluid return line extends into the chamber at one end and leads out of the borehole to a fluid depository, such as a storage tank. A fluid sensor within the chamber detecting the presence of fluid within the pumping chamber. A slug sensor can be located either proximate the pump or at a remote location to detect the beginning and end of a predetermined quantity of fluid.

An exterior housing can be placed over the borehole to contain the monitoring computer and associated read outs. A lightning protector, consisting of a ground electrode adjacent an electric service riser. A pair of ground wires, one affixed at one end to the electrode and at the other end to the exterior housing and the second affixed at one end to the housing and at the other to the computer and a faraday shield.

At least one shunt valve is affixed along the propellant and return lines inline. The shunt valve has body containing a recessed receiving area, a propellant line channel, a fluid return line channel, and a connection passage between the channels. A powered cylinder, with input and output connectors, extends into the body adjacent the receiving area. A series of connection hoses are connect to the cylinder inputs and outputs to connect multiple shunt valves. A valve plate, pivotally connected to the receiving area has an open port and is affixed to the powered cylinder to pivot the port in and out of alignment with the connection passage in response to movement of the cylinder. A cylinder activation member activates movement of the cylinder in response to coming into contact with borehole fluid.

A receiver/separator tank has a base with multiple connectors, a fluid housing in contact with the base, a separator cap, an electronics housing proximate the separator cap and a housing top. A fluid outlet tube is connected to one of the multiple connectors to transport fluid collected in the base. A gas pipe extends into the housing and exits the base to remove gas separated from the fluid. A safety line, having a pressure relief valve at the base of the housing, extends into the house proximate the gas pipe. A propellant supply line extends into the tank to connect, through a 3-way valve, to the supply line leading to the pump. A liquid return line brings fluid from the borehole into the housing to be separated from any gas contained in the fluid. The separator, at the end of the liquid return line is spaced from the separator cap and has a T-connector with angled outlets. The angled outlets direct the fluid at an angle to fall to the base where it is removed. At least one sensor within the tank communicates with the controller. The sensors are placed within the tank at a different heights. The 3-way valve has a supply line connector, a propellant line connector and an exhaust line connector. A moveable member alternates the connection between the propellant line and the exhaust line and supply line to connect the propellant line to the supply line in a first position and the propellant line to the exhaust line in a second position.

BRIEF DESCRIPTION OF THE DRAWINGS

The advantages of the instant disclosure will become more apparent when read with the specification and the drawings, wherein.

DETAILED DESCRIPTION OF THE INVENTION

Figure 1:
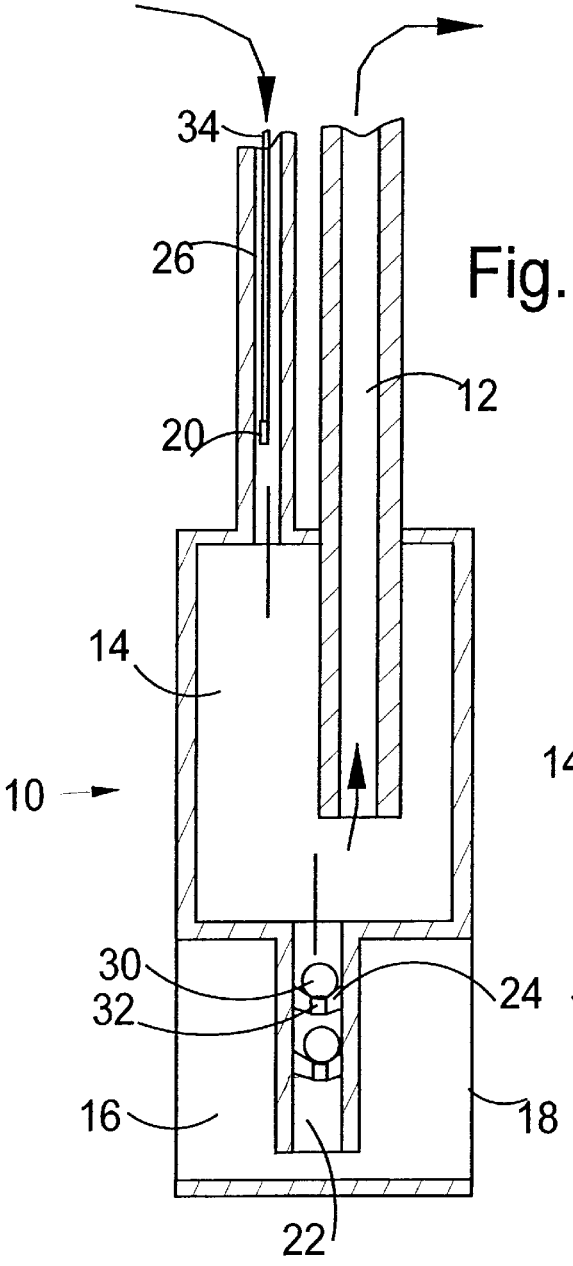
FIG. 1 is a cutaway side view of the system in the pumping mode.

The on-demand pumping disclosed herein provides an enhanced level of production of approximately 20%, while providing energy savings. Since the pump only operates when fluid is present, further savings are achieved through reduced maintenance while automatically accommodating the natural changes in fluid flow. In prior art systems, a pumper would have to make any timing changes required, based on, in many cases, "best guess" estimates.

Several pumps, such as disclosed in U.S. Pat. No. 4,842,487 to Buckman et al, which is incorporated herein as though cited in full, address the need for compact pumps for use in boreholes and the like. None of these pumps, however, provides means for controlling the pumping cycle other than a basic "on/off" using level switches. In the instant invention, the disclosed computerized controller for use with borehole pumps, including the '487 pump, enhances the control of the pump to increase production rates and lower maintenance costs. Additionally, the use of the computerized controller system can allow for remote monitoring capabilities as well as compilation of data relevant to well production and pump performance.

The "pump-on-demand" function is not typically found on pump jacks, which in most cases are controlled by timers which simply turn the pump on at periodic intervals and pump for a set, predetermined period of time. There is thus, in most cases, no correlation between the pumping mode of the pump jack and the presence of any specific amount of fluid in the borehole. Pumping when there is no fluid in the borehole causes unnecessary equipment wear and wasted energy. Conversely, when the pump kicks on too infrequently, the oil is allowed to accumulate in the hole to the point of becoming stagnant, causing a loss of production. As stated hereinafter, once the hydrostatic head, or pressure caused by the fluid level in the borehole equals the pressure exerted by the incoming fluid, the flow into the borehole ceases. Additional yield benefits, as discussed further herein, are derived from maintaining and enhancing the flow of desired and valuable fluids such as oil and gas into the bore hole.

The rate of fluid flow into each borehole will vary dependent on many factors, such as geological shift, secondary or tertiary recovery processes, temperature, barometric pressure and even tidal forces. By pumping-on-demand, the change of flow is accounted for with increased pumping during high flow times and decreased pumping during lower flow.

For clarification, the following terms and definitions are used within the application.

$P_1$

Pumping Pressure (psi): This is the sustained pressure of propellant gas applied to the surface of fluid in the Propellant Line when a pump cycle is in progress. This pressure results in displacing the gas/fluid interface surfaces in both the Propellant Line and in the Fluid Return Line. Its value can not exceed the Maximum Standard Pumping Pressure (Max SPP) and should not be less than Minimum Standard Pumping Pressure (Min SPP). The pumping pressure is established as 90% of the setting of pressure control device and safely below the opening pressure control device pop-off devices. The latter Min SPP should not be established at less than the pressure that would develop slug lengths(l) so short as to be inefficient and result in excessive pump cycles to pump at an acceptable rate. Generally, Max SPP would not exceed 225 psi (Pressure Control Setting=250 psi). Further, Min SPP most likely should not be less than 50 psi. Within the above limits, P1 may be found by solving the following relationship subject to correction through experimental confirmation. It would be expected that in the dynamic pump mode, fluid specific factors such as viscosity, surface tension and temperature, as well as, conduit on pipe smoothness and fluid face velocity will have to be considered to more accurately solve for NPP.

$NPP_{(psi)}=0.433\times D\times L$ where 0.433 is a constant for the units selected D is density of the fluid in the column valves: Pure water 1.00

Brine—1.01 to 1.2, typically 1.1

Oil—0.85 to 1.1, typically 0.9

L is length of column above point of pressure measured in feet.

$P_0$

This is gas pressure within the Fluid Return Line. This pressure can result from residual pressure utilized to empty the receiver into the flow line/tank battery system and/or it may result from the capture of casing head gas and recycling processes. In the former case, $P_0$ should go to nearly zero (0) as the fluid slug is delivered to the tank battery. In latter case, this residual pressure should be offset by casing head pressure and inlet pressure to the propellant compressor.

The computerized controller is programmed to operate in three modes, monitor, pump and recovery. In the monitor mode, the system waits for an initiator, in the form of one or more sensor derived variable inputs, to indicate that a volume of fluid is present in the pumping system to permit efficient pumping to the surface. If the fluid level has not reached the sensor, the system simply continues its monitoring activities. If fluid is detected, the system is placed into the pump mode.

Simultaneously running in the background during the monitor mode is a watchdog timer subroutine. The watchdog timer serves as a back-up to the pump on demand system, activating the pump mode based on a preset or an adaptive time interval rather than sensor initiated demand. The pump mode is, therefore, initiated when either sufficient fluid is present or the watchdog period is exceeded. The watchdog subroutine is provided to ensure a maintained production of fluid from a well, even in the absence of an initiation stemming from a sensor derived variable input to the computerized controller. This function provides for the continued initiation of pump modes if, for example, a sensor should malfunction. The time periods between past pump mode initiations are retained in a specific memory of the controller, thereby allowing the watchdog timer period to be self-programming, or adaptive, to the latest, and presumably best, data. This adaptive capability continues, even when the pump modes are initiated by the watchdog timer rather than through on-demand pumping. This continued adaptive capability enables the system to retain the highest possible production yield and efficiency, even without input from all sensors. This adaptability, in part, results from feedback from the lower fluid level sensor 1110 located in the separator/receiver tank 1000 and described in more detail in FIG. 21. When a programmable number of pump cycles occurs without fluid being indicated by the lower fluid level sensor 1110, the watchdog timer period will lengthen the time between pumping cycles. The occurrence of pumping cycles without sufficient fluid can indicate, dependent upon other sensor inputs, that there was less fluid in the pump than appropriate for an optimal pump mode initiation. Conversely, the watchdog timer period can be shortened, again under program control, if the upper fluid level sensor 1130, located in the separator/receiver tank 1000, indicates fluid during or soon after a pump mode occurs. In this event, dependent upon other sensor inputs, it may be indicated that there was more fluid in the pumping system than appropriate for an optimal pump mode initiation.

After the recovery mode, the sensor is monitored by the controller to check for the presence of fluid. Although the descriptions herein describe the utilization of a down hole sensor, other means can be used to sense the presence of the fluid. Therefore, reference to a specific sensor, is not intended to limit the scope of the invention as the criticality is in the detection of the fluid level, not necessarily the method of detecting the level. Additionally, the sensor is used herein as a generic term and can include thermisters, wye sensor connectors (described hereinafter), level detection, light sensor to read back scattering, fiber optics, ultrasound, etc.

Two of the low cost ways to sense the presence of fluid at the sensor is through either voltage or pressure change. In the voltage change sensor 20 of FIG. 1, there is a change in a voltage developed between two terminals of a semiconductor resistor that is conducting a regulated constant current. This voltage change results from a resistance change of this resistor due to a discernible temperature change associated with its operation in the well bore gas phase environment compared to its temperature in the fluid phase environment. It is critical that the magnitude of this regulated constant current is coordinated with the dissipation ability of the sensor, as lack of coordination of the current and dissipation can cause the sensor to overheat. Although this coordination will be subject to the type of sensor being used, the need to correlate the two will be obvious to those skilled in the art. Numerous methods and sensors can be employed to indicate the presence of fluid and to initiate a pump mode, some of which are set forth heretofore.

Figure 2:
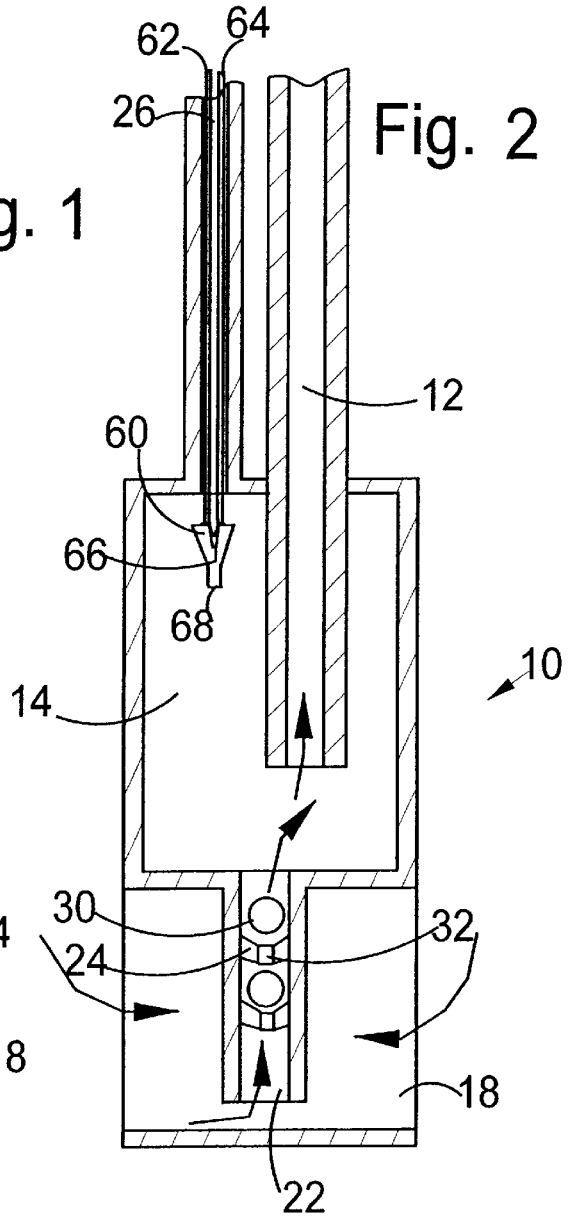
FIG. 2 is a cutaway side view of the disclosed pump system prior to entering the pumping mode.
Figure 6:
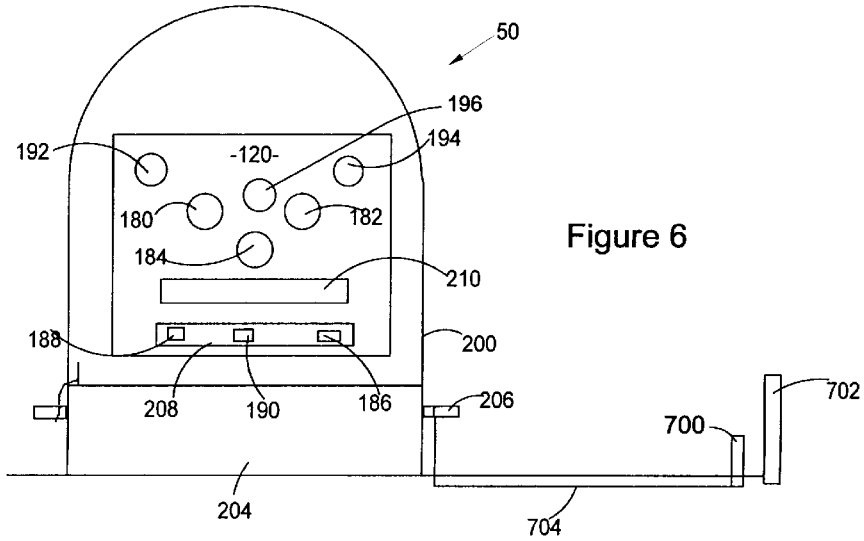
FIG. 6 is a side view of a pump system casing for use with the disclosed system.

In the embodiment illustrated in FIG. 2, pressure is used to detect the presence of fluid in the borehole. This embodiment provides an alternate to the low voltage sensor. The wye sensor assembly 60 uses two capillary tubes 62 and 64 extending into the borehole at about the depth of the chamber 14. This is most easily accomplished by attaching the wye sensor assembly 60 to the exterior of the fluid return line 12 at a specified depth near the entry point into the collection chamber 14. Alternatively, as illustrated, the wye sensor 60 can extend through the propellant line 26 into the chamber 14. These two capillary tubes 62 and 64 converge by the use of a wye connector 66 to a single open downward port 68. The downward port 68 is open to receiver the fluid as it rises in the borehole. The first capillary tube 62 is connected, at the surface, to a source of high-pressure gas of the same type as it used for the pump propellant; requiring a flow of less than 0.1 cubic feet per hour. The second capillary tube 64 is connected at the surface to a differential pressure transducer with a full-scale pressure capability equal to, or greater than, the maximum propellant pressure available. The reference port of the differential pressure transducer is connected to the well head annulus for pressure compensation purposes. When the downward port 68 is open, that is immersed in fluid, the pressure applied to the differential pressure transducer, by way of capillary tube 64, essentially equals the annulus pressure. The electrical signal output from the transducer, under these conditions, would indicate zero pressure differential. A fluid immerses the downward port 68, the pressure required to overcome the hydrostatic head of the immersing fluid and continue the flow of high-pressure gas through the immersed port 68 increases. Therefore, as the fluid rises within the borehole, the free flow of the gas through the capillary tube 62 is blocked. As the gas flow continues at essentially the same rate, eventually sufficient pressure is developed within the capillary tube 62 to force a bubble of gas through the downward port 68. This increase in gas pressure is conveyed by the second capillary tube 64 to the sensing port of a differential pressure transducer, located near the controller 120 (FIG. 6). The controller 120 is capable of calculating the fluid level (h) above the downward port 68 by reading the signal thus developed by the transducer, according to the following relationship:

$$h = \frac{P_{(PSI)}}{\text{Rho} \times g}$$

Where:

Rho is the specific gravity of the fluid that is being detected;

g is the force in pounds, due to gravity, that is exerted on a one square inch surface due to a column of pure water that is one foot in height; and h is the height in feet of the fluid being detected above the immersion port.

This method not only detects the presence of fluid in a borehole, but it also quantitates the height of the fluid above the downward port 68. The use of the wye sensor assembly 60 locates the expensive equipment, i.e. the differential pressure transducer, above ground in a protected environment; exposing the plastic wye connector 66 and capillary tubes 62 and 64 to the borehole environment. A further advantage is received by the elimination of any electrical or electrically conductive components within the borehole environment. The elimination of electrical components dramatically reduces the chances of the system being damaged by lightning strikes.

The system remains in the down hole pump mode until the slug sensor 28 used with the specific system configuration initiates the termination of the pump mode. Alternatively, the pump mode can continue for a predetermined, although programmable, period of time, however, this is not the optimal embodiment as it reduces the efficiency of the pumping system. Once the pump mode has been completed, the recovery mode is entered.

The recovery mode is the time during which the sensor 20, if employed, and compressor 40 reset and recover. Also during the recovery mode, the propellant gas line 26 pressure is allowed to equalize with the borehole pressure. The recovery mode, described in more detail hereinafter, is on a preset, although programmable, timed interval which is based on the recovery and reset times required by the equipment currently in use.

Figure 3:
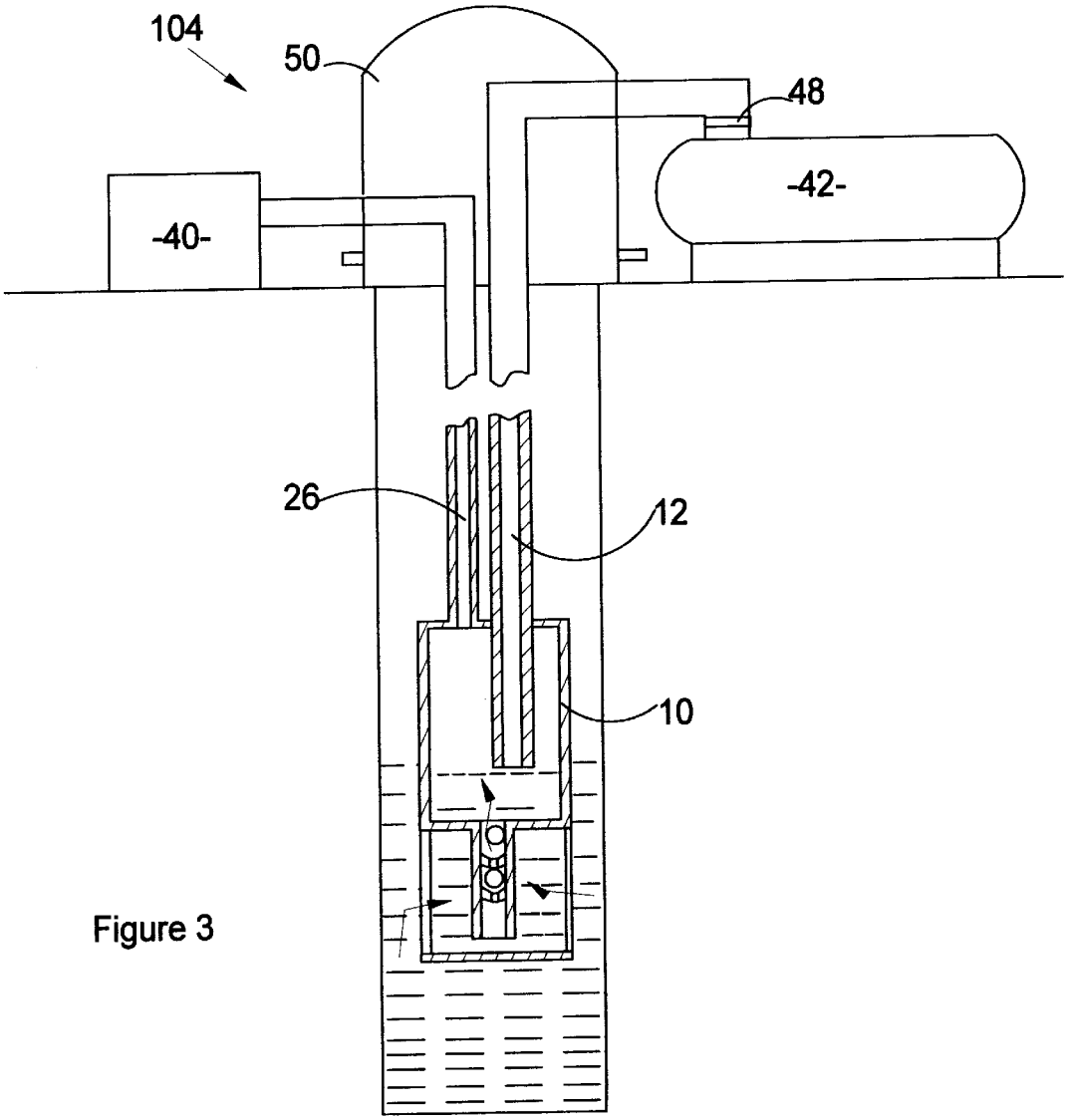
FIG. 3 is a cutaway side view of the pump system of FIG. 1 in a borehole.

The pump 10, illustrated in FIGS. 1, 2, and 3, is an example of a pump that can be used with the monitoring system of the instant invention. The pump 10 has a fluid return line 12 which serves as a conduit to convey the fluid from the collection chamber 14 to a storage tank on the surface. The lower portion of the pump 10 has multiple inlets 18 placed along the entire periphery of the inlet are 16, which can be any convenient configuration for manufacture. As the fluid rises within the borehole, the fluid enters the inlet area 16 through inlets 18. Although the inlets 18, illustrated herein, are on the sides of the pump 10, the inlets can also be placed along the bottom of the pump or elsewhere. Raising the inlets facilitates the separation of the fluids from unwanted solids, such as sand, silt or scale. It should be noted that the inlets can be placed in a location best suited to the conditions encountered in the borehole and/or the type of fluid being pumped. As shown in through the Arrows of FIG. 2, hydrostatic pressure forces the fluid to rise from the inlet area 16, through the open end of the valve passage 22 to the collection chamber 14. The valve passage 22 is provided with valve seats 24 that, while permitting upward flow through the ports 32, provide a receiving area for the check balls 30 once the upward flow of fluid ceases. As the fluid rises through the valve passage 22, the check balls 30 are lifted from their seats by a very small pressure differential, allowing the fluid to flow into the collection chamber 14. The fluid continues, in response to borehole fluid hydrostatic pressure, to rise within the collection chamber 14. Once the chamber 14 is filled, the fluid continues rise up the propellant line 26 until the fluid comes into contact with the down hole fluid sensor 20 or wye sensor 60. The propellant line 26 conveys pressurized propellant gas to the gas/fluid interface of the pumped fluid prior to entering the collection chamber 14. Due to the connection between the propellant 3-way control valve 1090 during the recovery and monitor modes, gas that is initially present within the collection chamber 14 and propellant line 26 is able to be easily displaced by the incoming fluid. This allows for pressure equilibrium between the gas within the annulus and the chamber 14, thereby allowing the fluid to freely enter the collection chamber 14.

Once the fluid has risen to immerse the down hole fluid sensor 20, of FIG. 1 or sensor 60 of FIG. 2 a signal is sent to the controller 120 that fluid has risen to a suitable level and, combined with other sensor inputs, initiates the pump mode. The placement of the sensor within the propellant line 26 provides the additional advantage of cleaning the sensor as propellant flows through the propellant line 26.

Although the computerized controller 120 is preset to monitor a multitude of necessary criteria at each well 104, the specific voltage developed by the fluid sensor 20 corresponding to the preferred fluid level to initiate a pump mode must be individually programmed for optimal control. Likewise, the specific voltage corresponding to a fluid level lower than that for a pump mode to be initiated is also individually programmed. This provides the greatest reliability of control function, overcoming variables such as borehole fluid temperature and other thermal kinetic properties of the fluids to be pumped, sensor signal cable length, material properties and sensor tolerance. This procedure is referred to herein as sensor wet and sensor dry calibration procedure, the practice of which is describe in more detail hereinafter.

When the system is using a downhole sensor, the sensor 20 must be programmed to "learn" the appropriate responses. Upon completion of the mechanical installation of the down hole pump system components, including the propellant and fluid pipe lines 26 and 12, the casing head closure is secured at the surface. The fluid level sensor 20 and signal cable 34 assembly are fed into an access port at the head closure and down inside of the propellant line 26. The signal cable 34 and sensor 20 assembly must be manufactured of materials that provide adequate strength and resistance to naturally occurring borehole fluids, as well as possible treatment chemicals. Additionally the signal cable 34 must be provided with suitable electrical properties to allow for the sensor 20 to communicate with the controller.

With the other end of the signal cable 34 connected to the controller 120, the sensor "wet" light 180 of FIG. 6 flashes. This indicates that the controller 120 is ready to be programmed to recognize a wet status. The sensor 20 is allowed to advance a measured distance down within the propellant line 26 until it is submersed in fluid, the level of which had been previously established. To accept the signal from the sensor 20 as being a valid wet signal, the operator button 188 is pressed and held until the sensor wet light 180 turns off.

Subsequently the dry light 182 flashes, indicating that the controller 120 is capable of being programmed to recognize a dry sensor status. At this point, the sensor 20 is raised approximately 25 feet above the previously determined level of fluid in the collection chamber 14 and/or propellant line 26. A pressure tight bushing is secured about the signal cable 34, at the access port, in order to confine propellant pressure within the propellant line 26. A pump mode is then manually initiated. Upon the completion of the pump and recovery modes, the programming of the controller 120 may be completed. The dry light 182 continues flashing indicating that the controller 120 is ready to be programmed for the sensor dry value. The sensor 20 has already been conditioned by its immersion into the typical fluid to be pumped as well as typical conditions that occur within the pump and recovery modes. To accept the signal from the sensor 20 as being as valid dry signal, the operator button 188 is again pressed and held until the sensor dry light 182 turns off.

Using the foregoing data, the system calculates a midpoint value between the experienced sensor wet and sensor dry values and stores this value, plus or minus dither, as a threshold for valid detection. This programming method provides for the greatest reliability of controller operation and virtually eliminates false responses to fluid detection sensor input. Some sensors will not require the wet/dry settings and the necessity of establishing these settings will become apparent to those skilled in the art.

Figure 22:
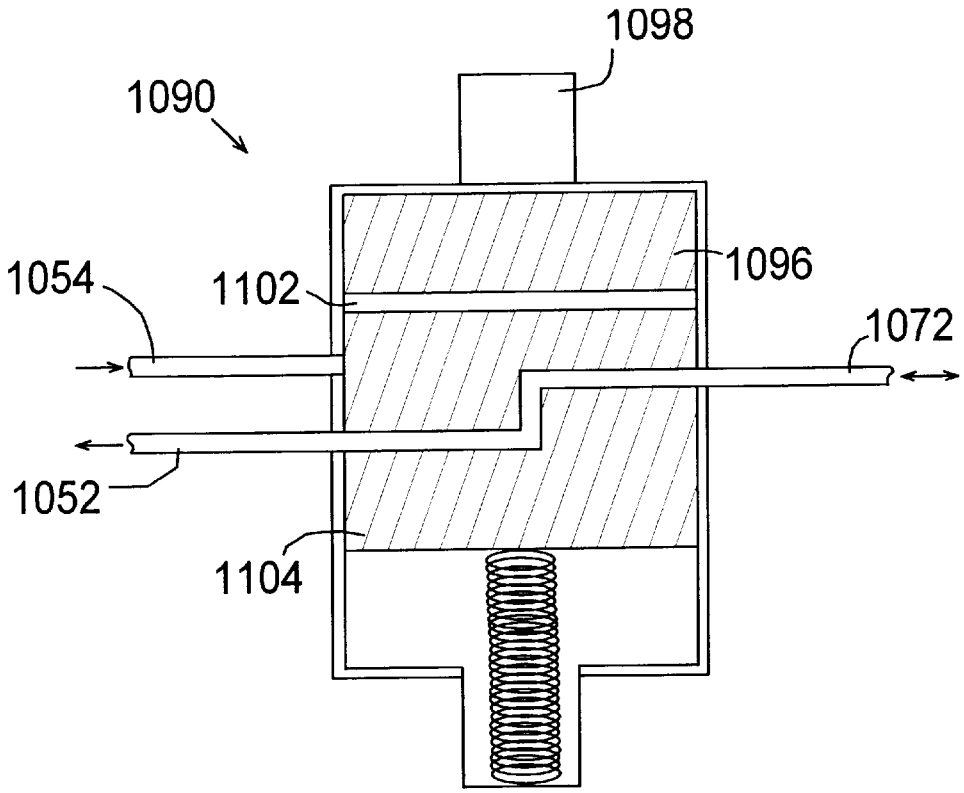
FIG. 22 is a cutaway side view of a 3-way valve used in the recovery mode.
Figure 23:
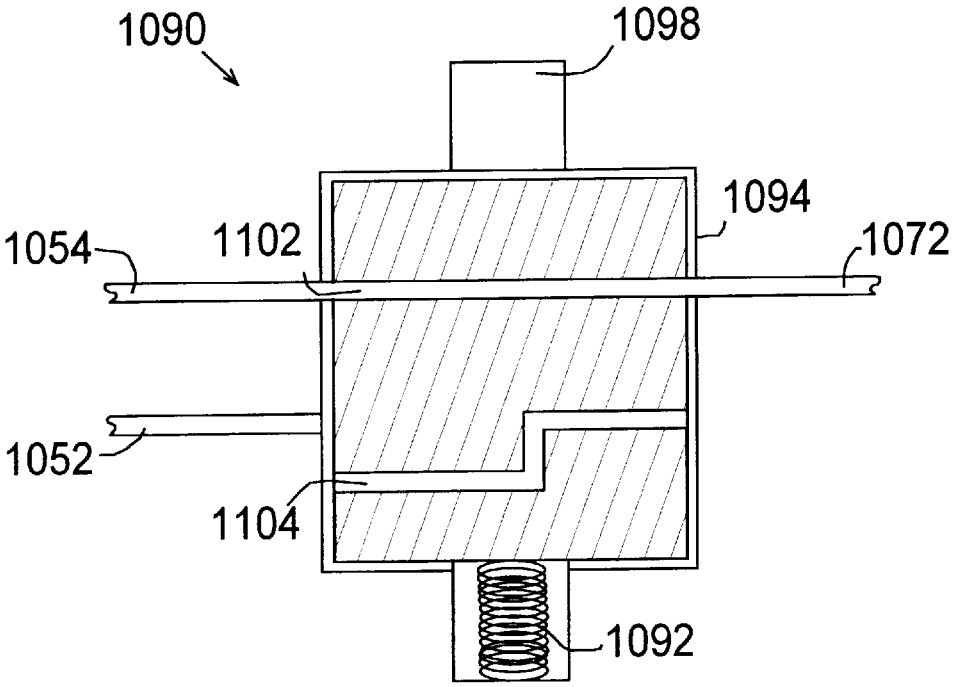
FIG. 23 is a cutaway side view of a 3-way valve in the pumping mode.

In the monitor mode, the indicator lights 180 and 182 indicate the status of the sensor 20 as wet or dry, respectively. Both of these indicator lights are extinguished during the recovery mode, at which time the sensor 20 is briefly supplied greater current by the controller to hasten sensor recovery from the effects of fluid immersion and propellant gas flow. This briefly increased current provides for a quicker stable fluid level detection signal, once the recovery mode is completed. At the same time, beginning with the recovery mode, gas pressure within the collection chamber 14 is allowed to equilibrate through the 3-way control valve 1090 (FIGS. 22 and 23). The pressure in the annulus permits fluid to enter and recharge the collection chamber 14, propellant line 26 and fluid line 12. Only after the recovery mode is complete and the monitor mode entered will the signal level from the sensor 20 be considered as valid for indication of fluid level.

It should be noted that the housing 50 can additionally be provided with controller interface inputs, such as keyboard, touch screen, infra red, radio frequency, etc. The controller interface enables the user to make necessary changes to the program in the field.

Immediately lowering the current to the sensor 20 provides a more accurate response curve in the event the fluid flows back into the borehole quicker than previously programmed into the system. The rate of current change is preferably a preset value that cannot be user defined.

During the pump mode, gas pressure preferably is applied by way of the 3-way valve 1090 through the propellant line 26, to force the fluid out of the chamber 14 and up the fluid return line 12. The pressure also forces the check balls 30 to rest on the valve rests 24, thereby blocking ports 32. By blocking the ports 32 the fluid within the collection chamber 14 is prevented from exiting through the valve passage 22, as well as preventing additional fluid from entering the collection chamber 14. As the propellant moves through the propellant line 26 is displaces the fluid collected in the collection chamber 14 out through the only available passage, the fluid return line 12. Although the system as described refers to the transfer of a slug of a fluid, by altering the tubing diameter, thereby increasing the volume of propellant, the fluid can be transferred in a column rather than a slug. Additional control of the volume of fluid brought to the surface can be obtained through varying the size of the collection chamber 14 and length of the pump mode.

The pressure to move the fluid slug can be provided by either an electric or gas powered compressor. Alternatively, borehole gas pressure can be used as disclosed in U.S. Pat. No. 5,006,046, which is incorporated herein as though recited in full. The compressor, or gas source, is monitored by the controller 120 to allow a single source to furnish compressed gas to multiple wells. The operation of the compressor 40 is monitored by the controller 120, with any malfunction being immediately reported to a central reporting facility. The performance of the compressor 40 can be characterized by a recovery profile within a predetermined period of time. The operating range of the compressor 40 is preset at a predetermined pressure to minimizes wear, tear, and energy consumption. By providing communication between the compressor 40 and the controller 120 within the housing 50, the propellant storage tank (not shown) pressure can be monitored, and manipulated, to coordinate with demands of the pumping cycle. The operating pressure range of the compressor 40 can only be modified over a specific band and is still provided with safety controls, including a electromechanical pressure switch and a safety pop-off or relief valve.

In the event a receiver/separator 1000 tank, as described further herein, is not used, a slug sensor is required. As illustrated in FIG. 3 the slug sensor 48 is not located within the borehole. When the signal is received by the controller 120 that the slug has reached the surface, or after a programmed delay, the system automatically terminates the pump cycle. In the event that the sensor 48 malfunctions, the controller 120 will continue to apply propellant gas pressure in the pump cycle for the duration of the maximum pump cycle time. The sensor 48 can either be a mechanical or non-mechanical fluid sensor with an analog or digital output. If the fluid sensor produces an analog signal, the system 120 must be programmed with a threshold detection value. If the fluid sensor produces a digital signal, then the system 120 will need to be programmed as to which digital level is present from an activated fluid sensor.

To optimize system efficiency, the pumping mode can be terminated once the slug is detected, allowing the residual pressure to push the slug into the storage tank 42. Therefore, the slug sensor 48 must be located a sufficient distance from the pump 10 to allow for the residual pressure to push the slug the final distance to the storage tank 42. The exact distance of the slug sensor 48 from the storage tank 42 is dependent upon system configuration, i.e. material pumped, rate of fluid flow into the borehole, depth of pump etc. In the event of a sensor failure, the watch-dog timer setting regulates the pump modes on a timed basis until the sensor can be required. After the pump mode, the system is in the recovery mode in which the propellant line 26 and the chamber 14 are allowed to equilibrate to the borehole pressure. As stated heretofore, the recovery mode is on a timed basis and, once the preset time has expired, the system will again monitor the downhole sensor for the presence of fluid.

The sensor 20 can include means for measuring differential pressure across the pump, thereby consolidating all monitoring systems into one, easy to access, device. Alternatively, the sensor 20 can be used to monitor, or report hydrostatic pressure, indicating the presence of fluid in the pump and/or height of fluid. The storage tank 42 can be equipped with a one way valve at the fluid outlet to prevent back flow. Optimally, however, a fluid/gas phase separator, receiver/separator 1000, described in conjunction with FIGS. 13–21, is positioned between the storage tank 42 and the fluid discharge tube 12. The receiver/separator 1000 contains high and low level sensors, thereby eliminating the need for the sensor 48.

Figure 4:
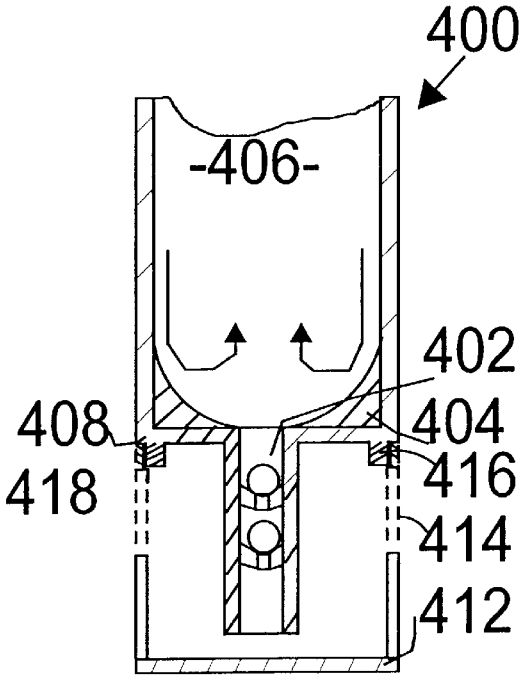
FIG. 4 is a cutaway side view of an alternate pump embodiment.
Figure 5:
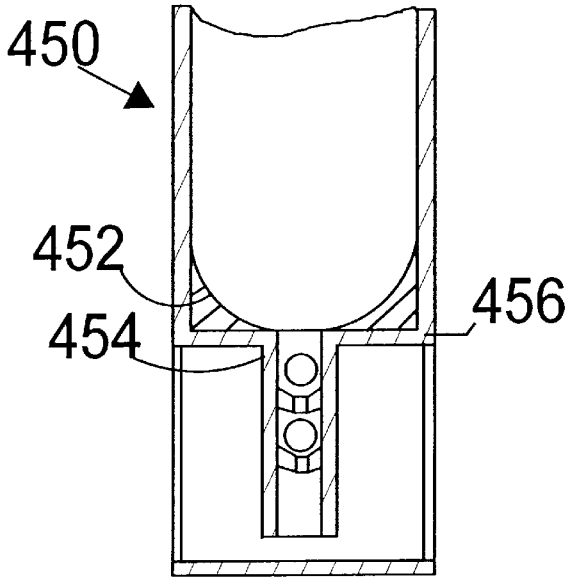
FIG. 5 is a cutaway side view of an additional pump embodiment.

In the alternate pump 400 configuration, illustrated in FIG. 4, the base 404 of the collection chamber 406 has been modified. The valve passage 402 has been modified to extend beyond the base frame 408 and the base 404 curved. This configuration enhances the upward flow of the fluid, as well as preventing build-up in the corners. The inlet chamber 412 in this embodiment is removable to permit alternate inlet chambers to be used with the same pump. This permits the same pump to be used with inlet spacing to accommodate the various borehole conditions and fluid being pumped. In the pump 400 the inlet chamber 412 has the inlets 414 spaced at the top of the chamber 412 rather than along the length of the chamber 412. The inlet chamber 412 is attached to the pump 400 through the use of a threaded ring 416 affixed to the pump base 408. The inlet chamber 412 is provided with a matching receiver thread ring 418. Other attaching methods can be used and will be apparent to those skilled in the art as will alternate inlet placement. In the pump 450 of FIG. 5, the chamber base 452 is curved, however the collection chamber inlet 454 remains flush with the base frame 456.

Fluid flows into the borehole from a certain level, or levels, known in oil wells as the pay zone(s). The fluid continues to flow into the borehole until the hydrostatic pressure of the fluid within the borehole is essentially equal to the pressure exerted by the fluid flowing into the borehole. At this point, due to the hydrostatic pressure resulting from the presence of fluid within the borehole, the fluid flow from the pay zone into the borehole is reduced to a minimum. Only residual pressure due to gas or fluid present in the surrounding pay zone(s) may cause any further rise in the borehole fluid level. Although this residual pressure may originate from natural causes, for example trapped or dissolved gas or due to the application of secondary or tertiary recovery methods, the effects are very difficult to predict. In prior art systems which are set to be activated on a timed basis, the fluid can remain at this level for a substantial period of time, dependent upon how accurately the timer is set. In the instant system, the fluid is pumped upon demand, that is, when a controlling parameter has reached a particular value. For example, if the goal is to maximize the production of a fluid value, the fluid should be maintained at a level in the borehole equal to, or lower than, the level of the producing pay zone(s). Allowing the fluid to raise higher than this level will invariable result in a lower recharge rate to the borehole and consequently a lower fluid production rate. The down hole fluid sensor 20, positioned at the level of the lowest producing pay zone, would be a way of initiating pumping cycles such that the fluid level is maintained at this level, thus maximizing the well's production.

Prior art systems, by pumping the fluid out for a preset period of time frequently over pump, bringing the fluid level below the pay zone(s). Once the fluid level is taken below the lowest pay zone, the cohesion of the fluid can be broken, requiring the well to re-prime itself. This slows the flow of the fluid into the borehole until the fluid has had time to re-establish cohesion. The disclosed system is set to stop pumping prior to removing fluid below the pay zone, thereby preventing any break in cohesion. This can be accomplished through either pump height adjustment, programming or a sensor at the pay zone(s).

In some areas, especially in winter, the paraffin contained in the fluid separates out in the standing fluid. Since paraffin tends to adhere to the metal, this separation causes the metallic pumps and associated metallic parts to clog. In the disclosed system, by preventing standing fluid, the paraffin is not given the opportunity to separate and the issue of adhesion to equipment is prevented. Sandy and granular soils cause a different problem with standing fluid in conjunction with prior art systems. Sand can settle within the borehole, eventually clogging the pay zone, slowing the fluid flow and causing wear on equipment. By using on-demand pumping, sand is not allowed to accumulate above the pay zone. As the fluid enters the borehole from the pay zone(s), silt and sand may be transported along with the fluid. When the fluid rises to an appropriate level for a pump mode to be initiated, the entire contents—fluid, sand and silt—are vacated from the propellant line 26, collection chamber 10 and fluid return line 12. By completely emptying pumping system, the accumulation of sand and silt within the borehole is effectively prevented. Further, by providing a near constant flow of fluid into the borehole, dependent on the geological make up and porosity of the producing formation, new channels are frequently opened, allowing for increased fluid flow.

In FIG. 6 an example housing 50 is illustrated. In addition to the wet 180, dry 182 and slug detection 184 lights and set button 188, other lights and LED readouts are provided to monitor the system. A program running light 192 is provided to indicate the presence of power and the program is running. The "Status OK" light 194 indicates that, although some settings may be diverted from preset standards, the system is up and running and will continue to pump. The system is programmed to provide maximum production and, therefore, will run even if settings, such as compressor pressure, are deviate a programmed amount from preset standards. As all electronics are connected to the controller 120, it is aware of any deviations, and will report the deviations without shutting down the system. The system should, however, be programmed to shut down completely in the event of specific, operation threatening deviations. Any deviations, whether manual or network correctable, are reported for correction.

A pumping mode 190 light indicates that the system is in the pump mode. Due to quiet operation of the system, it is difficult to determine whether the system is pumping without an indicator, such as a light or sound. The user interface button 186 allows a user to manually initiate and terminate the pumping cycle.

A power-on light 192 indicates that the system is receiving power and that the processor program is running. In the event of a power loss, the system does not lose any programmed parameters. An error light 196 is used to indicate a problem with either the program or parameters of the system. Each time the system is powered, the error light comes on while the diagnostic program is executed. If the system check does not detect any problems, the error light goes out. If, however, there is a problem within the system, the error light 196 remains on and, depending upon the type of error, the system will either run or shut down completely. If a parameter in memory has, for some reason, been corrupted, the error light remains on along with the "Status OK" light 194, at which point the system will preferably work for a short period of time to reduce production down time. The lights and read-out bars disclosed herein are for example only and other indicators may be used dependent upon the fluid being pumped, locations of the housing, etc.

New parameters can be programmed using a system programmer integrated circuit (I.C.) containing default parameters. The processor I.C. is replaced with a default program I.C., the power turned on and the default parameters entered. The system checks to verify that the program is running properly and, if not, activate the error light. When the parameters are correctly stored, the I.C. is removed and the original I.C. replaced. The initial parameters may take some time to set up, however subsequent controllers take only minutes to program. This is relevant to situations where multiple individual controllers 120 are being initially installed at a production site with common parameters. Substantial time savings can be obtain by "cloning" programmable integrated circuits for this type of installation.

The downhole fluid sensor's wet and dry level values are stored in the controller 120 upon installation. These values can subsequently be erased by engaging the user button 186 and cycling the power to the system. After applying power to the system with the user button engaged, the sensor wet indicator light 180 will begin to flash for several seconds. The error light 196 will also flash in sync with the wet sensor indicator 180 as long as the user button 186 is engaged. This indicates that the wet level value is about to be reset. After several seconds, the wet sensor indicator 180 will cease flashing and the dry sensor indicator 182 will begin to flash. Again, if the user button 186 is engaged, the error light 196 will flash in sync with the dry sensor indicator 182 indicating that the dry level value is about to be reset. If the user doesn't want the dry level value to be reset, he simply disengages the user button 186 and waits for the timer to expire. The same applies to the wet level value in that the user button 186 is disengaged while the wet level indicator 180 is flashing until dry indicator 182 begins to flash. Alternatively, the controller 120 can be programmed to permit the user to set only the dry sensor level value in the borehole and allow the controller 120 to calculate the wet sensor value or vice versa.

It is preferable that as much information as possible is displayed externally to prevent repeated opening of the example housing 50, thereby maintaining security. The housing 50 comprises an upper dome 200 and a well casing 204. The upper dome 200 can be removed from the stationary base 204 to allow access to the controller 120 and any internally displayed data or switches. On non-networked units, the data will need to be displayed on the unit at LED window 210. The data can be displayed in preset reports based on either a timed or on-call basis. The button panel 208, if accessible from the outside, should have the ability to be locked to prevent unauthorized access. Alternatively, the user button 186 can only be accessed from inside the housing 50.

Protecting the controller 120 and other equipment from lightning is a critical issue. Simply using a Faraday shield still subjects the system to lightning strikes and has allowed sensors 1000 feet below the surface to be damaged. Therefore, a ground type electrode 700 is driven into the ground adjacent an electric service riser post 702. The electrode 700 serves as a combination air and earth terminal and is applicable whether the service is overhead or underground. A #6 AWG solid copper, or equivalent, ground wire 704 is taken from the electrode 700 to the well casing head 204 where it is hooked onto the flange lug 206. The wire 704 can be buried just below the ground's surface. A second #6 AWG solid copper ground wire is hooked onto flange lug 208 and run to the interior equipment grounding conductor and internal faraday shield (not shown). This places all non-current carrying metal items bonded to a common earth terminal, thus virtually eliminating any difference potential. This arrangement favors the lightning to strike the preferred air/earth terminal 700, allowing the current to be harmlessly carried to the earth by way of the ground conductor 704, casing flange lug 206 and well casing 204. Any elevation in potential incident to a lightning strike would be felt also by the equipment grounding conductor and all non-current carrying metal items so bonded, thus providing the greatest possible protection to the associated electronic equipment.

A temperature sensor is included, preferably either within the housing 50 or proximate the housing 50, to monitor the ambient temperature. It can be harmful to the equipment to pump at temperatures lower than a minimum ambient temperature regarded as safe for pumping. In prior art systems, the pump would be manually shut down when temperatures fall below a safe operating point. This shut-down would remain until manually restarted, creating substantial production down time. The disclosed system continually senses the ambient temperature and ceases pumping when the ambient temperature falls to a preset temperature. Once the temperature rises above the preset value then the system automatically restarts. Thus in borderline weather, during the day when temperatures are higher, the system will restart and run until the temperature drops. In this way, production loss is minimized and safety is promoted. Also, an extended pump mode time is implemented when ambient temperatures approach the minimum temperature for pumping. This management strategy assures that the very least residual fluid will be retained in the above ground pump system components and thus facilitates the earliest resumption of full operation upon the return of safe ambient temperatures.

Figure 7:
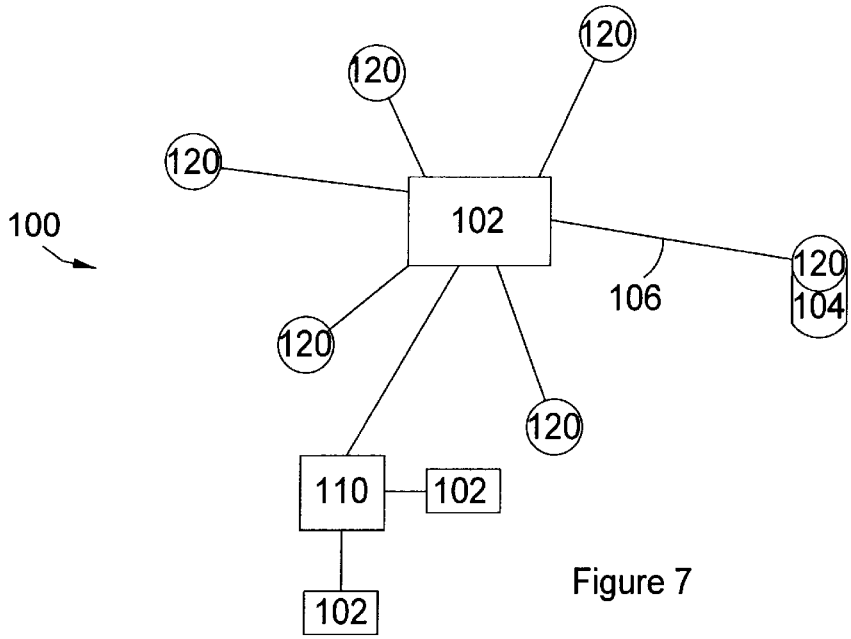
FIG. 7 is a schematic of the computerized system of the instant invention.

The disclosed pump system 104 can stand alone for use with a single well or be networked for multiple wells. The computer controller system 100 as illustrated in FIG. 7 consists of master controller 102 which operates the pumping process and data collection for each well controller 120 to which the unit is connected. In very large systems, the master controller 102 can communicate with a monitoring center 110. The communication between the individual well controller 120, the master controller 102 and the monitoring center 110 can be any method known in the art such as radio, cellular, satellite or hardwiring. A comparison between the cost of the equipment to run the system and the cost of installing communication links 106 would generally be the determination as to the number of wells connected to each master controller 102. In some instances, the economics may be most advantageous with each well 104 having a controller 120. Other locations and/or terrain may allow for multiple controllers 120 to be connected to a single master controller 102. In smaller organizations, the master controller unit 102 can be the only computer and be provided with the software to provide the required reports. The controllers 102 can download information to the monitoring center 110, database to database, on a preprogrammed schedule or process the information, downloading only the preprogrammed reports. The computers utilized in the instant system should have sufficient capabilities to manipulate the information in a format desired by the user. The inclusion of one or more computers within the disclosed systems is for specific examples. Any of the elements disclosed herein can be combined with other disclosed elements, such as the controller used in the system pumping the fluid directly to the storage tank can be incorporated into the receiver/separator tank controller. The combination of features will become apparent to those skilled in the art in view of the disclosure herein.

In some instances, such as in resuming power after an outage, more than one of the well processors 120 may come on line simultaneously. Although the master controller 102 can process more than one controller 120 simultaneously, any shared mechanical apparatus, such as the compressor 40, can only service one borehole at a time. Therefore, each well controller 120 is assigned a priority number to designate the pumping priority for that controller within the system. The priority numbers can be based on any preset criteria.

In cases where the system is initially installed as a network, the individual controller 120 can be eliminated with the sensors within the pump and receiving tank reporting readings directly to the master controller 102. The process, however, whether the monitoring is done at the individual controller 120 or the master controller 102, remains the same.

It is preferable that all materials are non-corrosive due to extended exposure to the environment. The compatibility with either 115 or 230 volt power sources permits the system to be used worldwide without alteration. All systems must be lightning resistant and well-grounded with surge protection, preferably as set forth above, to prevent, or at least minimize, storm damage.

In instances where pumped fluid from several pumps can go into a single receiving tank, each activation registers fluid being pumped. If the pump is activated and the tank does not register receipt of fluid, a problem is indicated after one cycle. The well, or wells 104, involved with the problem can be shut down immediately, saving a possible line break from becoming problem. The storage tank sensors also permit the master controller 102 to keep track of fluid pumped and determine the most effective pick up schedules for the fluid transporter to pick up the fluid from the storage tank 41. Management of fluid levels in these storage tanks is important because they must not be allowed to overflow; otherwise, produced fluid is lost, environment damage results and fines and penalties are likely to be imposed by agencies of jurisdiction. This is applicable for all fluids being pumped, whether it is oil or salt water.

Figure 8A:
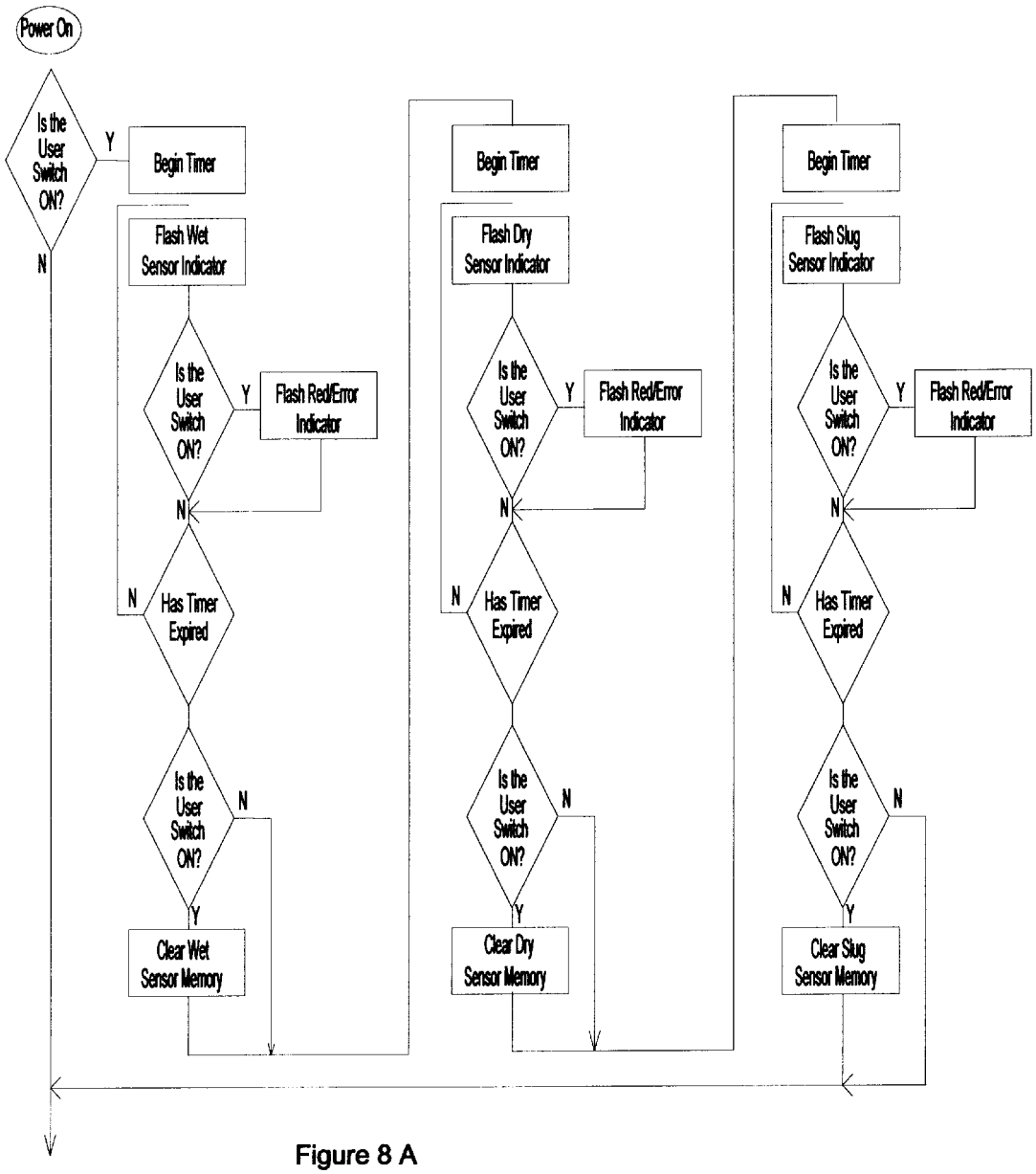
FIGS. 8 A and B are a flow chart of an example software flow.
Figure 8B:
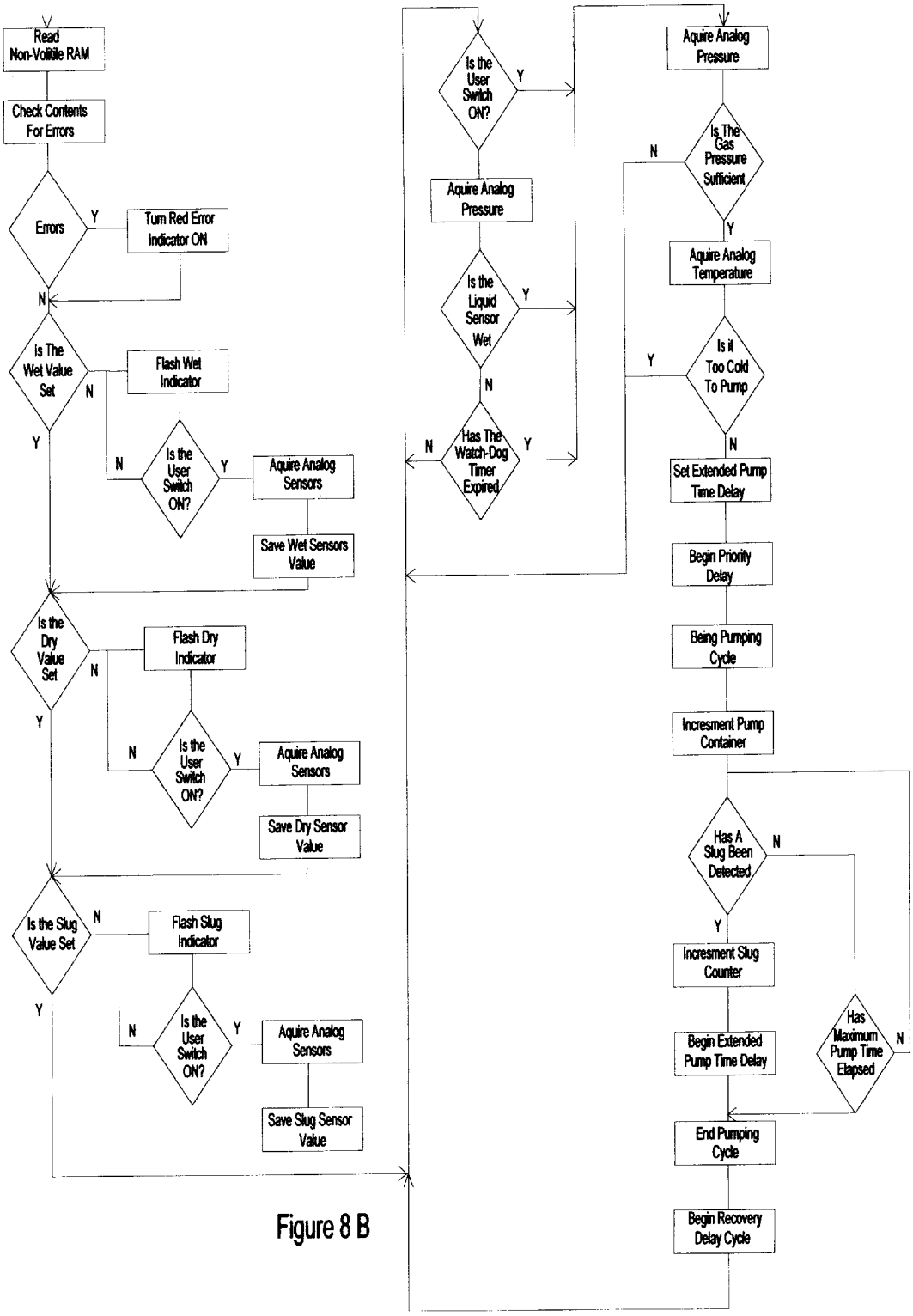

The system illustrated herein incorporates many parameters, most of which are factory preset and three user settings (fluid sensor wet, dry and slug detection threshold). The controller 120, or master controller 102, is programmed to monitor and check the wells 104, storage tank 42 fluid level and compressor 40 and store this monitored information in the appropriate databases. FIGS. 8 A and B are a flow chart of an example sequence for the disclosed system. As well known, there are various languages, as well as databases, which permit the desired results to be achieved. It is, however, the sequencing of steps, cross-checking and the results which are critical and any program which meets these criteria can be utilized.

The storage tank 42 and auxiliary systems are preferably placed underground to minimize environmental impact and to improve aesthetics. Due to the compact equipment size, low sound level and cleanliness, the system is more readily accepted in both urban and rural areas than prior art systems. It is important that safety features be incorporated into the system to minimize any ecological damage. One of the safety features incorporated includes a level sensor (not shown) in the storage tank 42 for the immediate notification of a possible fluid leak or theft of the tank contents. Since the storage tank level sensor is capable of resolving the fluid addition occasioned by each pumping cycle, the reduction or cessation of fluid addition would cause a notification of a possible leak in some part of the pumping system. With the possibility that this could be a leak in the fluid line 12 between the wellhead 104 and the storage tank 42, the system can be programed to shut down any further activity until an operator can verify that no environmental damage will occur. By constantly monitoring the fluid level, the controller 120 knows how much fluid is being pumped each time. If the quantity of fluid pumped remains the same while the time between deactivation and the activation decreases below preprogrammed tolerances, the controller 120 notifies either the master controller 102 or the monitoring station 110 of a probable discharge tube 12 leak. Additionally, if the quantity of pumped fluid drops below preprogrammed levels, the monitoring center 110 is notified by the master controller 102 that there is a problem within the system. In this way, if a sensor is inoperable, the system can continue to pump the fluid on a timed schedule. A comparison of the number of times the system enters the pump mode with the number of times the sensor requests initiation of the pumping cycle is also monitored. In the event the two numbers do not match, the system should notify the monitoring center 110. The foregoing are examples of the notification and monitoring abilities of the disclosed system. Other events can also be monitored and the notification sequence altered, depending upon the arrangement and number of computers within the system.

In the preferred embodiment, the software access is in three levels, all of which are encrypted and only accessible by password. The first level is a "ready only" program and permits the system to be monitored by the employees. The second level provides limited access and allows for the alteration of selected criteria which do not affect the data records and dominate features of the program. An example of second level access would be altering the length of the maximum pump time, minimum pump temperature, etc. The third level access is used for altering a field parameter.

In order to protect the integrity of the system, the third level can preferably only be accessed for a short period of time. By allowing third level access only for short periods of time, it is more difficult for unauthorized parties to gain entry. The high level of security within the system helps prevent unauthorized access into the system by hackers.

To ensure that the system operates optimally, critical values are pre-loaded into the non-volatile ram and can only be altered via the network interface. Examples would be the minimum pressure and temperature for pumping and range of temperature for extended cycle pumping. The information that is critical to the optimal operation of the system and the information which can be varied will be obvious to one skilled in the art in light of this disclosure.

The software continually collects data from the pumping cycles, including the number of cycles within a given time period and the amount of fluid produced during a time period, thereby allowing for optimization of the pumping cycle. Temperature, which affects fluid flow, is also monitored and taken into account in the pumping cycles. This further increases the advantage of on-demand pumping by changing the pumping cycle to correspond to the increased or decreased fluid flow. Reports can be programmed to be generated automatically based on predetermined parameters. The automatic generation is also advantageous in that report times can be set to generate the same report at the same time each day, thereby eliminating another variable. Further criteria can be set into reports, such as specific temperatures, fill times, etc.

Because of the "pump-on-demand" feature, and the ability to precisely track the pumping cycles, the computer controller system 100 can more accurately determine production levels in a given well 104 than is possible by the vast majority of technology currently used in the field. By being connected to a number of wells 104 in a given field, the system can track production from each well and collect the production information for reporting to owners, investors, etc. The computer controller system 100 thus becomes an excellent, and unique, tool in "managing" leases. The system further eliminates the need for "pumpers" to go into the field regularly to manually check the operation of the wells and/or maintain the equipment. Many wells will have an enhanced initial flow, a factor that is generally not attainable in prior art systems.

Figure 9:
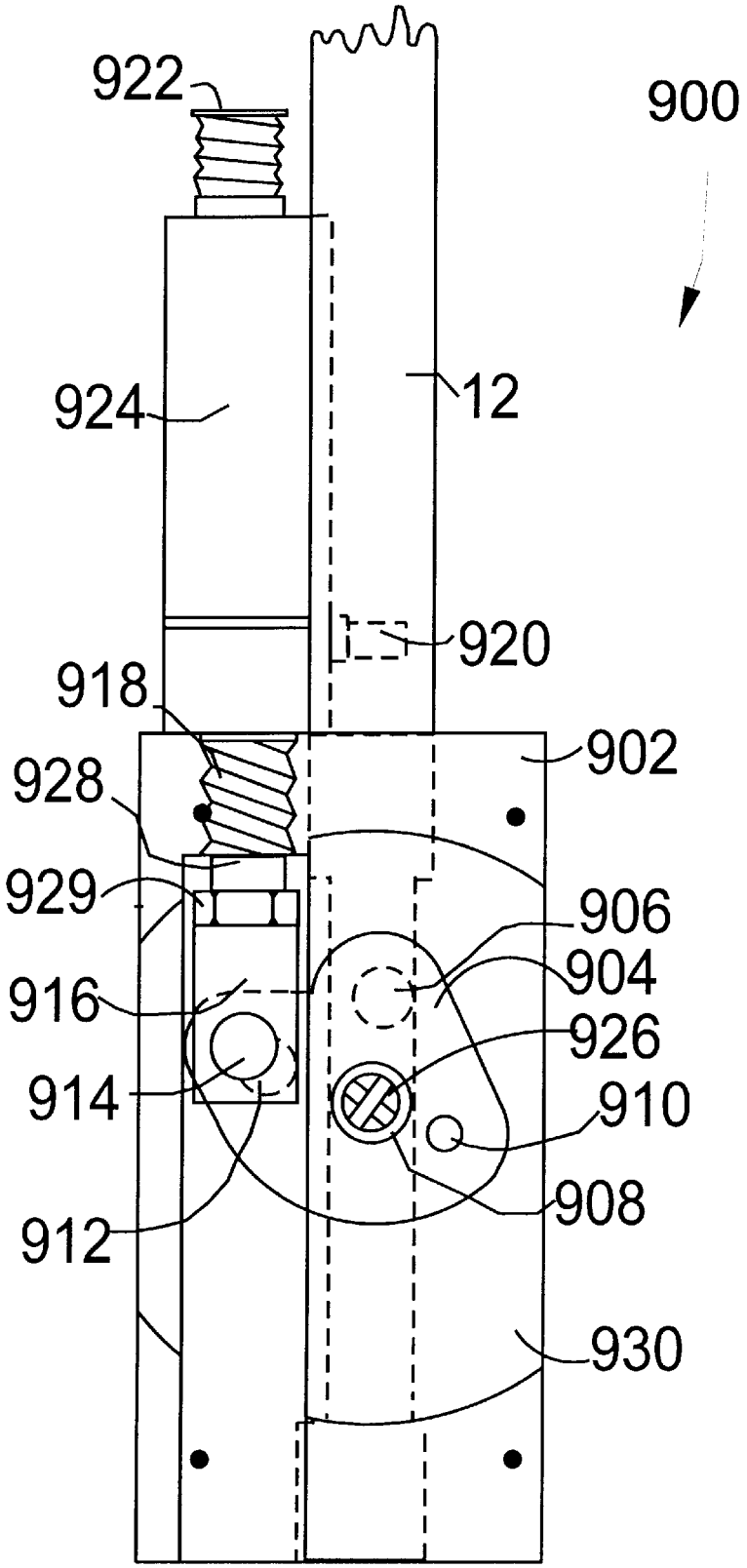
FIG. 9 is a cutaway side view of the shunt valve of the instant invention.
Figure 10:
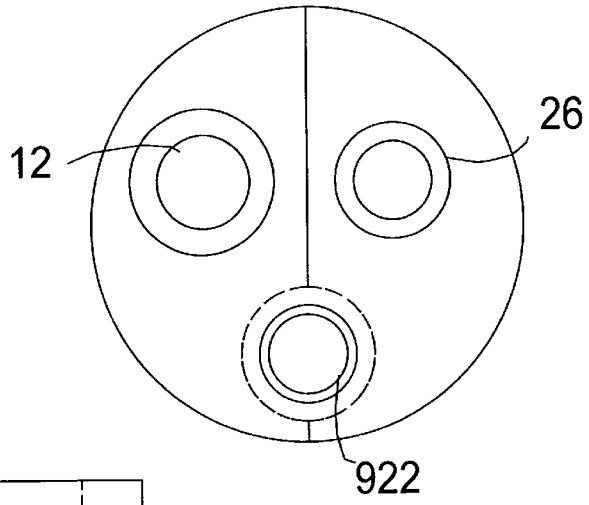
FIG. 10 is a top view of the shunt valve of FIG. 9.
Figure 11:
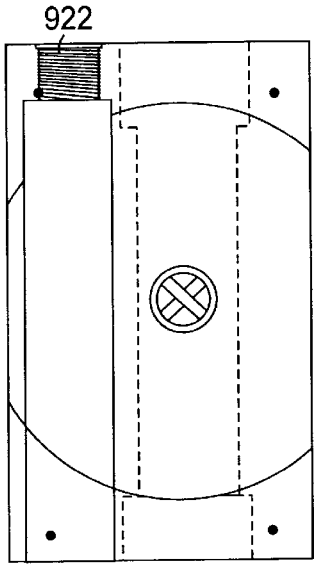
FIG. 11 is a sectional side view of the exterior of the shunt valve.
Figure 12:
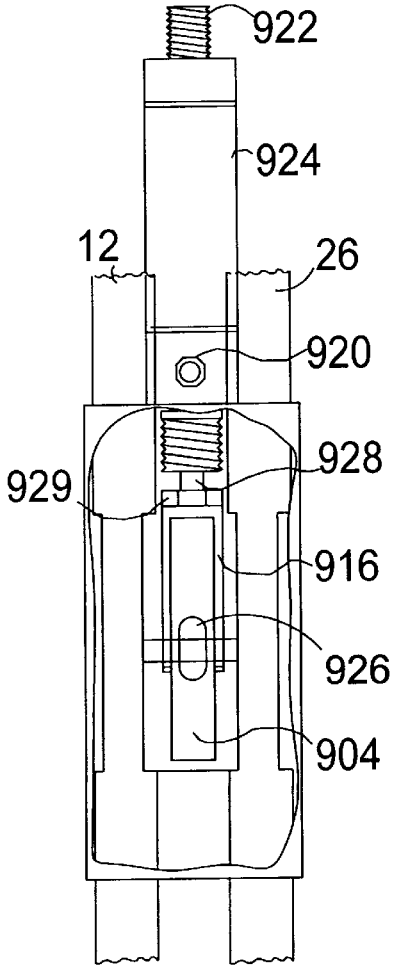
FIG. 12 is a cutaway front view of the shunt valve.
Figure 13:
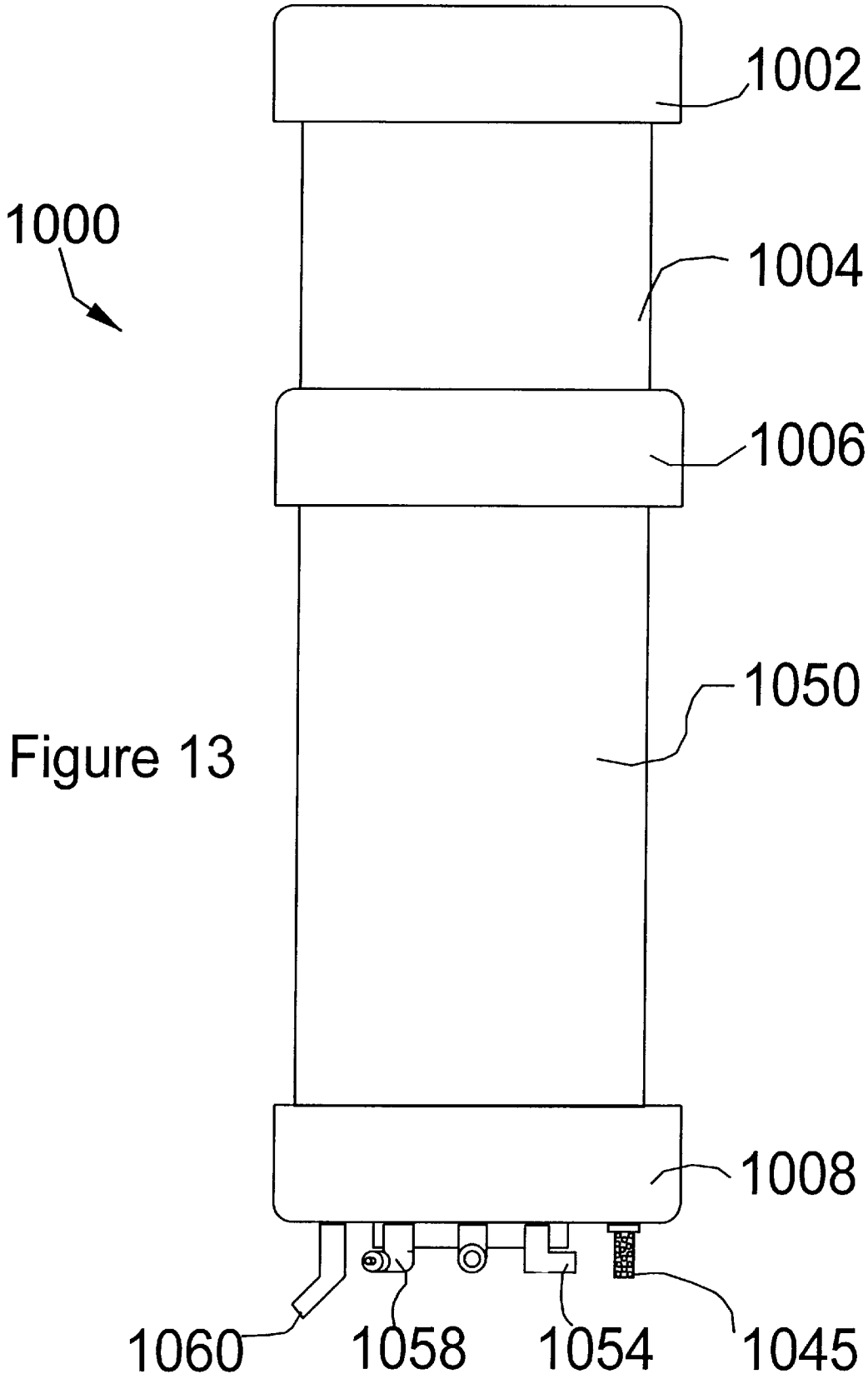
FIG. 13 is a front view of the exterior of the fluid/gas separator tank.
Figure 14:
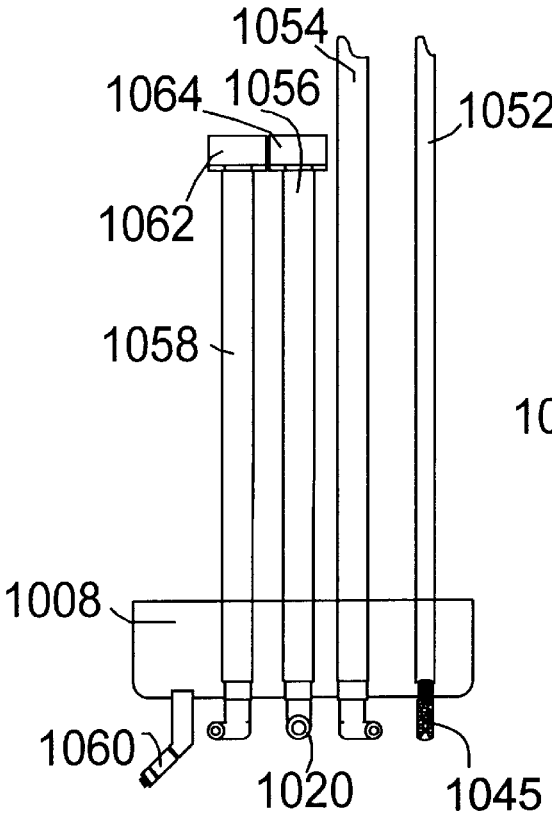
FIG. 14 is a side view of the interior of the fluid/gas separator tank.

A problem occurring in many pumping situations is the build-up of fluid within the borehole during an electrical outage or other periods of pump shut down. The amount of fluid which builds up during this power outage results in a much longer column length developing in the fluid discharge line 12 when next pumped. This in turn requires greater propellant pressure than is routinely employed with the pumping system. In order to eliminate this problem, shunt valves 900, illustrated in FIGS. 9–12, are installed approximately every two hundred (200) feet along, and between, the propellant line 26 and fluid return line 12. The valve 900 consists of a fluid passage 926 that connects the propellant line 26 to the fluid return line 12. The opening and closing of the passage 926 is controlled by a valve plate 904 that is activated by a pneumatic air cylinder 924. The cylinder 924 and the valve body 902 are held together by a threaded extension 918 that receives the rod 928. The valve plate 904 is connected to the air cylinder 924 by a rod 928, a nut 929, clevis 916 and clevis pin 914. The valve plate 904 has a pin receiving area 912 greater than the diameter of the clevis pin 914 to prevent the valve plate 904 from becoming trapped between the clevis pin 914 and the pivot pin 910 as it rotates. The valve plate 904 rotates around a pivot pin 910 connected to the valve body 902. The pivot pin 910 allows controlled movement of the valve plate 904 within the recessed area 930. To prevent fluid from leaking into the recessed area 930, an O-ring 908 is recessed partially into the valve body 902, concentric with the fluid passage 926, between the valve plate 904 and the valve body 902. The valve plate 904 is illustrated in FIG. 9 in the open position, with the closed position being such that the contact area 906 covers the passage 926. The piston within the cylinder 924 is caused to move by the resultant of forces applied to both the top and bottom of this piston. Borehole pressure is conveyed to the lower surface of this piston by the way of the inlet filter 920. This pressure can arise from gas within the borehole or from hydrostatic pressure from fluid as it immerses the cylinder 924 or from the combination of both of these sources. At the same time, a programmable pressure is applied to the upper surface of the piston. When the hydrostatic pressure resulting from fluid rising in the borehole above the location of a particular cylinder 924 exceeds the program pressure by a sufficient amount to overcome total valve mechanism friction, then the piston moves upward. The rod 928, nut 929, clevis 916 and clevis pin 914 are all connected to this piston and as its moves upward, the valve plate 904, pivots about the pivot pin 910. In operation, immersion of the cylinder 924 by a specified amount of borehole fluid results in the valve plate 904 rotating clockwise, aligning its open port with the passages 926 in the valve body 902. The cross connection at this shunt valve 900, located between the propellant line 26 and fluid return line 12, provides for the establishment of a developed column during the pump mode that routinely available propellant pressure is capable of discharging a column of fluid from the pumping system. Conversely, when the borehole fluid level has been sufficiently reduced, such that the program pressure applied to the upper surface of the cylinder piston can overcome the reduced borehole pressure felt on the lower surface of this piston plus the total valve mechanism friction, the valve plate 904 is caused to rotate counter-clockwise, closing off the passages 926 in the valve body 902.

Thus, when the fluid within the borehole mounts to a level where the pressure activates the cylinder 924 through the filter 920, the valve plate 904 is moved to the open position. The fluid within the borehole has, at this point, risen within the propellant line 26. Once open, the fluid within the propellant line 26 is transferred to the return line 12 through the shunt valve 900. The placement of the shunt valves 900 along the propellant and return lines 26 and 12, respectively, reduces the pressure required to pump the fluid out of the borehole by reducing the volume of fluid to be transferred. One the hydrostatic pressure is reduced (fluid is lowered about the cylinder 924 level) the valve plate 904 automatically transfers from open to closed position.

In order to maintain the shunt valve 900 in working order, it must be protected from the surrounding fluid. The body 902 is preferably sealed tightly and the recessed area 930 molded within the body 902. The recessed area 930 needs to have a sufficient width to allow for movement of the valve plate 904, however any open space beyond that movement area can be designed based on manufacturing preferences.

The shunt valves 900 are connected to one another through a flexible hose (not shown) which is attached to the threaded connector 922. Although the hose is attached to, and receives program pressure from the main compressor, the full pressure from the compressor is too high for the shunt valve 900 system. Therefore, a regulator is required to reduce the pressure to a level program pressure that is usable by the shunt valve 900 system. When multiple shunt valves 900 are placed within the bore hole, the program pressure is applied to all cylinders simultaneously. If the hydrostatic pressure within the bore hole is sufficient at this level to open the valve plate 904, the fluid is pumped through the first valve 900. If, however, the hydrostatic pressure is insufficient, indicating that sufficient fluid has not risen above the first cylinder 924, the pressure within the hose is also applied to the next valve 900. Proceeding downward to reach a valve having sufficient hydrostatic pressure to activate the valve 900, the valve plate 904 is opened and the fluid pumped through its passage 926. The process is repeated until the fluid level has dropped to the point where the pump 10 can resume normal pumping. The hose is connected to the valve through use of a threaded connector, adhesive and/or other methods that will maintain the connection securely within hostile environments.

In some instances, there is a leakage of gas into the borehole. In accordance with EPA regulations, this gas cannot be released into the atmosphere. In the disclosed system, the gas which is emitted from the borehole can be either put back into the borehole, or reclaimed by being placed into a separate container or a gas pipeline, using the disclosed fluid/gas separator.

In order to separate the fluid and gas, once the fluid has reached the surface, it is placed into a receiver/separator tank 1000 prior to being placed into storage tanks. The receiver/separator tank 1000 consists of a tank top 1002, which is sealed to prevent water, dirt, etc. from harming the electronics within the electronics housing 1004. The receiver/separator cap 1006 divides the receiver/separator housing 1050 from the electronics housing 1004 and the receiver/separator base 1008 retains the entry pipes in the appropriate positions.

Figure 15:
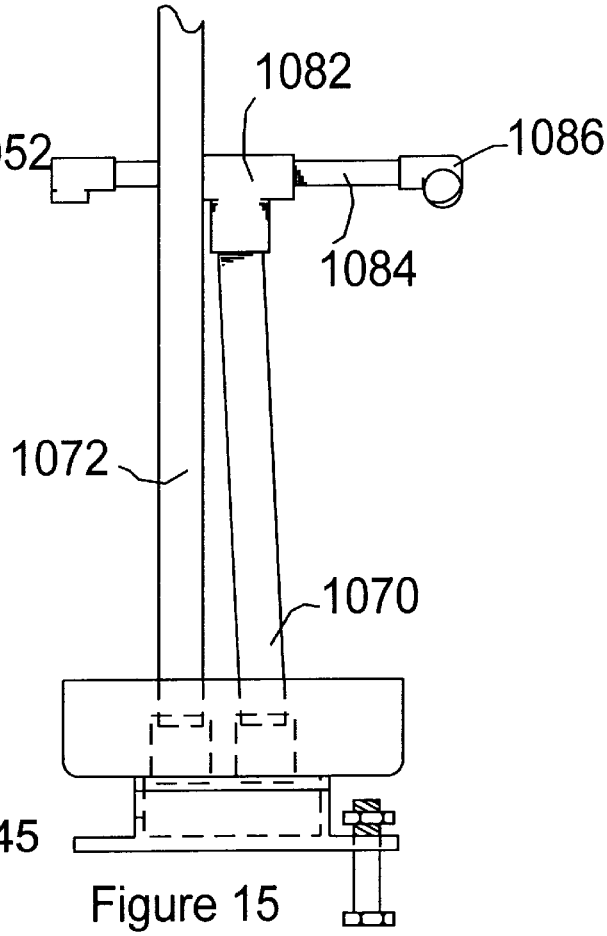
FIG. 15 is an additional side view of the interior of the separator/receiver tank.
Figure 17:
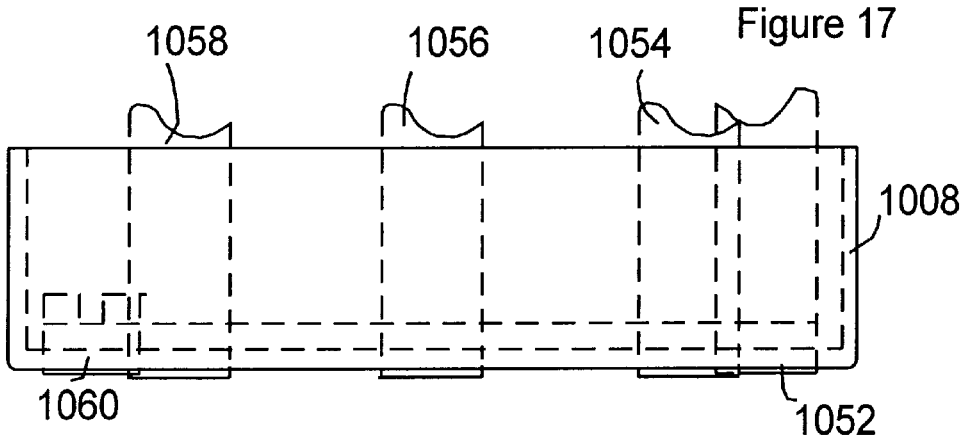
FIG. 17 is a cutaway side view of the base of the separator/receiver cap.
Figure 16:
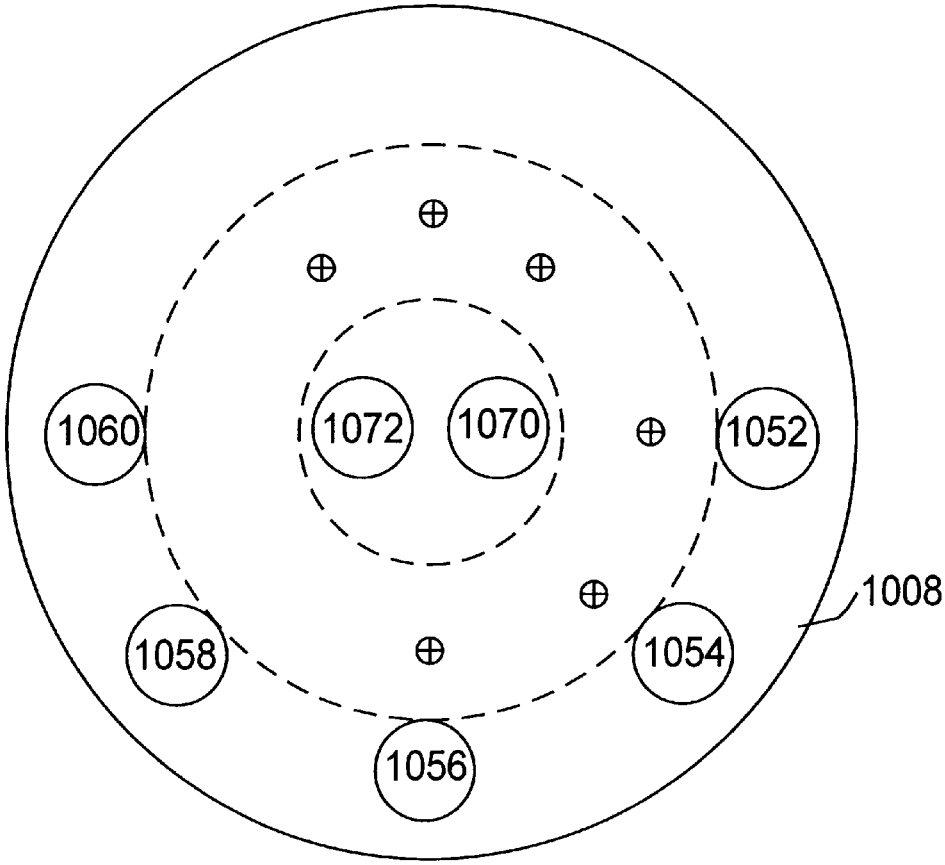
FIG. 16 is an interior view of the bottom of the separator/receiver tank base.

The interior of the receiver/separator housing 1050 is illustrated in FIGS. 14–21. FIG. 16 illustrates the interior of the receiver/separator base 1008 showing the entry placement of the incoming pipes. The fluid outlet 1060 enters the tank 1050 and remains flush with the base 1008, as can be seen clearly in FIG. 17. The fluid outlet 1060 collects the fluid from the floor of the base 1008 and transfers the fluid from the receiver/separator housing 1050 to the fluid storage tank 42. The gas pipe 1058 extends proximate the receiver/separator cap 1006 and is fitted with a fluid baffle 1062, which is illustrated in more detail in FIG. 19. A safety line 1056 runs through the receiver/separator housing 1050 at about the same level as the gas pipe 1058 and is fitted with fluid baffle 1064. The safety line 1056 is further fitted with a pressure relief valve 1020 that permits the escape of built-up pressure within the receiver/separator housing 1050. This is a safety precaution in the event, for some reason, the gas is unable to leave through pipe 1058.

The supply line 1054 extends up the through the receiver/separator housing 1050 and is connected the a 3-way control valve 1090, "in port". The valve 1090 can be placed in either the top of the separator cap 1006 or, as an alternative, near or attached to the receiver/separator 1000. An example of the 3-way control valve 1090 is illustrated in FIG. 22, as it would be positioned during the recovery and monitor modes and in FIG. 23 during the pumping mode. The valve 1090 comprises of a body 1094 that contains a movable valve spool 1096 that moves vertically within the body 1094. The interior of the spool 1096 contains two channels, a recovery channel 1104 and the pumping channel 1102. During the recovery and monitor modes, the valve 1090 permits, through channel 1104, connection between the propellant line 1072 and the exhaust line 1052, blocking the access between the supply line 1054 and the propellant line 1072. Once the actuator 1098 is energized, during the pump mode, the propellant gas is conveyed into propellant supply line 1054, through channel 1102, to the propellant line 1072. The actuator 1098 can be energized by electrically and/or air pressure. The most convenient method of energization will be apparent to those skilled in the art. In the pump mode, the spool 1096 within the valve body 1094 moves downward against a spring 1092. This allows the pumping channel 1102 to complete the connection between the propellant line 1072 and the supply line 1054. Once the pump mode is complete, the valve 1090 is de-energized and the spool 1096 is pushed upward by the spring 1092. The upward movement blocks the supply line 1054 and connects, through use of recovery channel 1104, the propellant line 1072 to the propellant exhaust line 1052. The exhaust line 1052 preferably ends at an exhaust muffler 1045 (FIG. 14) that can be used when compressed air is used as the propellant gas and recovery of the gas is not an issue. The 3-way valve illustrated in FIGS. 22 and 23 is an example of a configuration that is applicable to the disclosed system. Other valves that provide the same separation of connections and withstand the environment can be substituted.

The exhaust line 1052 extends from the 3-way valve and passes through the housing to exit at the propellant exhaust muffler 1045. It should be noted that when environmental and/or safety regulations prohibit the release of gas into the air, the muffler 1045 can be replaced with a connection leading to an appropriate containment vessel. The propellant line 1072 and fluid return line 1070 are illustrated in FIG. 15. The propellant line 1072 extends from the 3-way valve 1090, through the receiver/separator tank 1050 to be connected to the pump. The fluid return line 1070 extends from the pump to proximate the top of the tank 1050 where it is connected to a spiral diffuser 1080 through use of a T-connector 1082. The elbows 1086 are attached to the ends of the cross bar 1084, preferably at an angle which optimizes the separation of gas and fluid phases. By using the spiral diffuser 1080, the fluid is separated from the gas. If the elbow 1086 is pointed straight down, the fluid/gas combination simply pours down to the bottom of the receiver/separator tank 1050, resulting in poor phase separation. If the elbow 1086 is pointed straight up, again any separation is impeded. Although the angle is not critical, the greater the angular velocity, the more thorough the separation between the fluid and the gas. As the fluid and gas are separated, the lighter gas phase is directed into the gas pipe 1058 and the fluid collected in the separator/receiver base 1008 is discharged through the fluid outlet 1060. Using an appropriately coordinated pressure unloader, or relief valve, installed on the gas outlet 1058, residual gas pressure retained in the receiver/separator can be used to discharge the fluid contents to a remote storage tank 42. The necessity of connecting the fluid outlet 1060 to a fluid transfer pump is dependent upon the height between the receiver/separator tank 1000 and the storage tank 42 and will be obvious to those skilled in the art.

Figure 20:
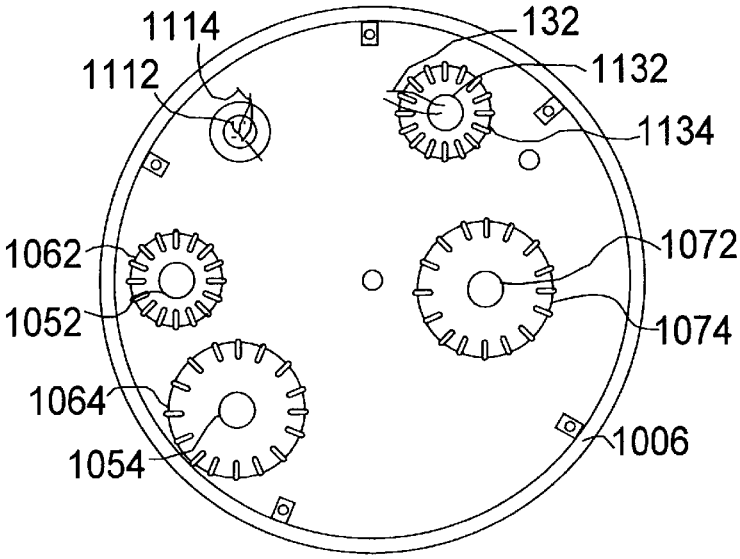
FIG. 20 is a top view of the top of the cap of the separator/receiver tank showing the pipe feedthrough for pipes entering the control valve compartment.
Figure 19:
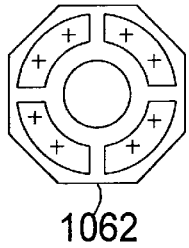
FIG. 19 is a top view a fluid baffle used at the entry point of both the gas phase outlet and gas phase pressure relief ports.
Figure 18:
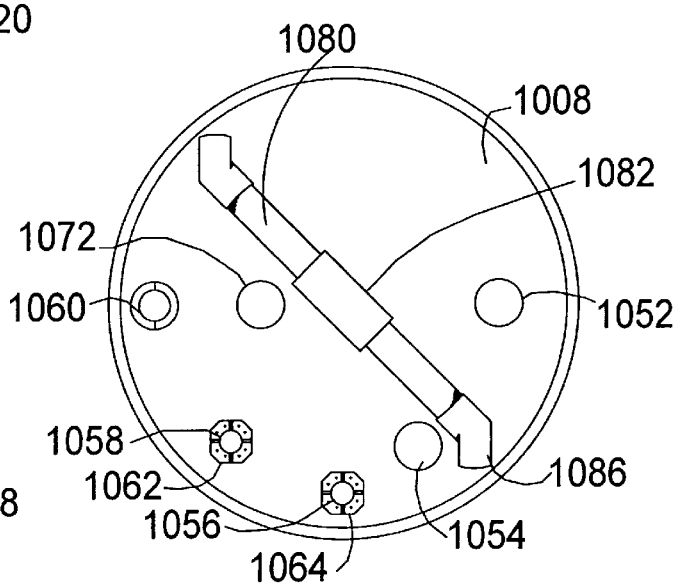
FIG. 18 is a top view of the interior of the separator/receiver tank.
Figure 21:
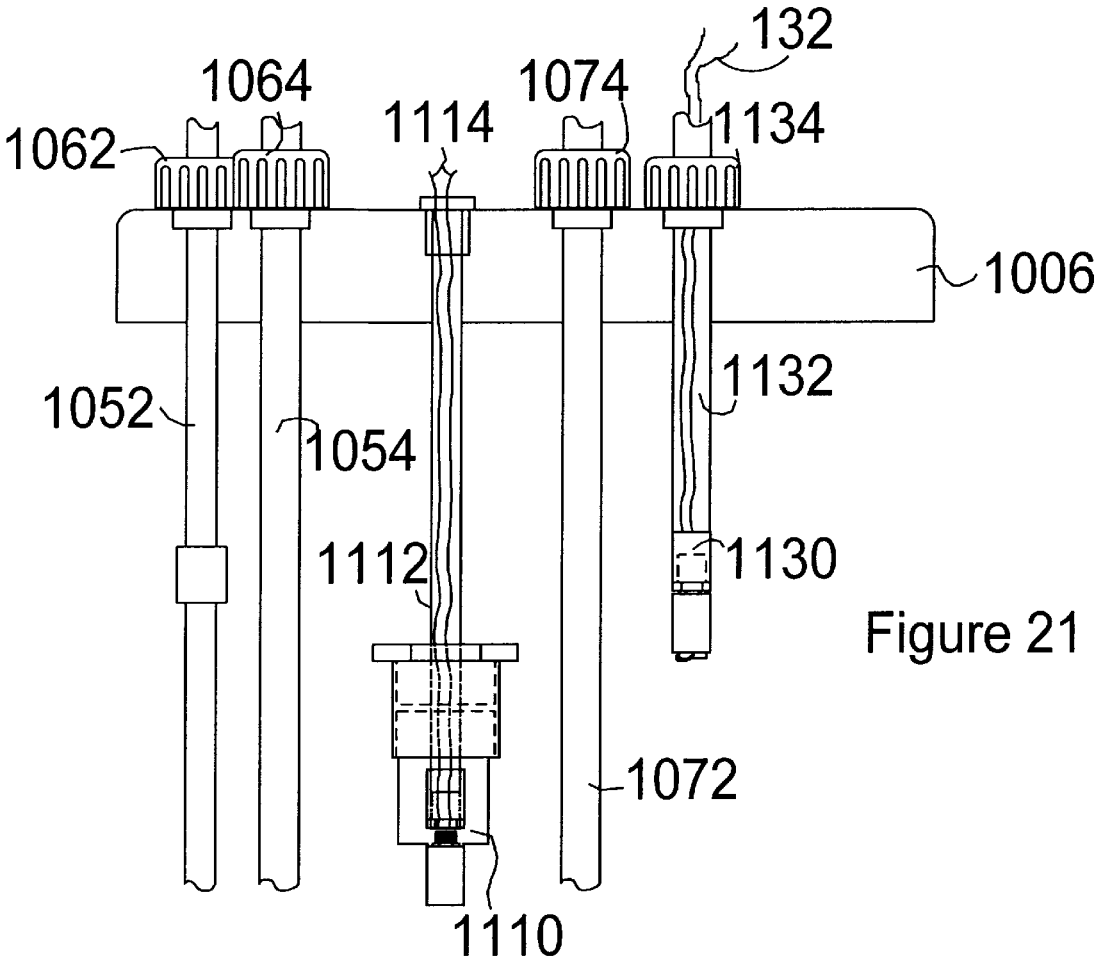
FIG. 21 is a cut away view of the separator/receiver tank, showing the fluid level sensors.

FIGS. 20 and 21 illustrate the upper and lower receiver/separator sensors 1110 and 1130. As illustrated, the lower fluid level sensor 1110 is a float switch with an external housing protecting the switch, although other sensors can be used which may or may not require protective housing. The lower fluid level sensor 1110 is affixed to the cap 1006 of the receiver/separator through use of a stationary pipe 1112 which carries the electronic leads 1114 from the sensor 1110 to the controller 120 (not shown). The upper fluid level sensor 1130 is an example of an alternate design for a sensor that can also be used as the lower fluid level sensor 1110. The upper fluid level sensor 1130 is affixed to the cap 1006 by a rigid pipe 1132. The pipe 1132 and sensor 1130 are adjustable as to height within the receiver/separator 1000 to permit adjustability of the sensor 1130 based on the fluid volume. The pipe 1132 is secured in position through use of bushing 1134 which, when loosened allows for the sensor 1130 to be raised or lowered. The interior of the pipe 1132 carries the leads 132 from the sensor 1130 that notify the controller 120 (not shown) of the presence of fluid at the upper allowable level. Both sensors 1110 and 1130 provide information to the controller that permits modification and maintenance of an efficient pumping cycle. The lower fluid sensor 1110 also serves as a slug sensor, replacing sensor 28, to notify the controller 120 of the detection of a slug and therefore the end of a pumping cycle. In order to keep the controller 120 from executing upon a false signal or flutter of the fluid level sensor(s), a validation routine is employed. This provides for a more accurate and consistent controller response and saves wear on other system components. FIG. 21 also illustrates the connection of the supply line 1054, exhaust line 1052 and propellant line 1072 to the cap 1006 through use of a bushings 1064, 1062 and 1074 respectively.

The pump on demand system, in combination with the receiver/separator, can also be incorporated in gas wells. Water frequently enters gas boreholes once the borehole depth has extended below the water table. Once water enters the borehole, the pressure exerted by the water prevents the gas from entering the borehole. Current gas pumping technology utilizes a computer controller to tabulate the amount of gas being pumped. By combining the gas pumping technology with the disclosed system, the advantages of on demand pumping and monitoring can be provided in a gas well environment. The disclosed system can also be used to pump, control and monitor water at other locations, such as landfills and dumpsites, meeting federal requirements. In water flood situations, or even the standard monitoring of landfills, the disclosed system will respond to the varied flows. In reclaiming areas, knowing quantity of fluids in the tank on day by day basis will also for the effective charting of water flood activity that is enhancing tertiary recovery. Currently the tanks are physically gauged by tape and plum bob system, taking one to two months to find an average.

The computer controller can be modified to apply this method of control in removing contaminated fluids, hazardous waste and well water projects. A sensing device that detects the type of fluids by measuring chemical compositions or gas emissions, can be incorporated into the pump, inputting data to the controller to initiate the pumping of contaminated fluids or target fluids.

Although the foregoing system has been described in conjunction with the pump disclosed in copending applications, other pumps, such as described in the '487 patent or which can be modified to correspond with a computer, can also be used.

Since other modifications and changes varied to fit particular operating requirements and environments will be apparent to those skilled in the art, the invention is not considered limited to the example chosen for the purposes of disclosure, and covers all changes and modifications which do not constitute departures from the true spirit and scope of this invention.

What is claimed is:

1. A pump for removing fluid from boreholes based on the fluid achieving a predetermined level, said pump having:

a. an elongated pump housing, said elongated pump housing having an interior, an exterior, a first end and a second end;

b. an inlet chamber, said inlet chamber being adjacent said second end of said pump housing, said inlet chamber having multiple fluid inlets to permit fluid to enter said inlet chamber;

c. a valve system, said valve system extending from said second end of said pump housing into said inlet chamber, said valve system enabling one way fluid flow between said pump housing and said inlet chamber to enable said fluid to flow from said inlet chamber into said pump housing during a filling mode and preventing said fluid from exiting said pump chamber during a pumping mode;

d. a propellant line, said propellant line having an outlet entering said housing proximate said first end and a compressor connected to an inlet of said propellant line to send propellant into said propellant line;

e. a fluid return line, a first end of said fluid return line extending into said pump housing through said housing first end and a second end extending into a fluid storage area;

f. a fluid sensor, said fluid sensor detecting the presence of fluid within said pump chamber, wherein fluid enters said inlet chamber and is forced by hydrostatic pressure into said pump housing, said fluid rising until said fluid sensor activates said propellant, said propellant forcing said fluid through said fluid return line into said storage area.

2. The pump of claim 1 wherein said inlet chamber is removably affixed to said exterior of said second end of said elongated chamber.

3. The pump of claim 1 wherein said interior of said second end of said housing is U-shaped, said valve entering said housing at the base of said U-shaped interior of said housing.

4. The pump of claim 1 wherein said valve system extends into said second end of said pump housing.

5. The pump of claim 4 wherein said interior of said second end of said housing is U-shaped, said U-shape curving from said interior's wall to said valve system extending into said housing.

6. The pump of claim 1 wherein said valve system comprises spaced, parallel walls having at least two inline valve seats within said walls, each if said inline valve seats having a open port to enable fluid flow and a check ball, said check ball permitting fluid flow into said pump housing and preventing fluid flow out of said housing.

7. The pump of claim 1 wherein said fluid sensor is a wye sensor having two capillary tubes, a first end of said tubes being affixed to said wye sensor and a second end of a first tube being connected to a pressure source and a second end of said second tube being connected to a port of a differential pressure transducer.

8. The pump of claim 7 wherein said fluid sensor is programmed to recognize the presence of said fluid and the absence of said fluid.

9. The pump of claim 1 further comprising a slug sensor, said slug sensor being in sensing proximity with said fluid return line to detect the beginning and end of a predetermined quantity of fluid.

10. The pump of claim 1 further comprising a slug sensor, said slug sensor being in sensing proximity with said fluid storage area to detect the beginning and end of a predetermined quantity of fluid.

11. The pump of claim 1 further comprising a receiver/separator tank, said receiver separator tank separating said fluid from gas contained within said fluid.

12. The pump of claim 1 further comprising at least one monitoring system, said monitoring system having a program to read, store and evaluate data obtained from said level sensor and said slug sensor, and activation and deactivation data of said compressor, wherein said system adapts a secondary program to activate and deactivate said compressor based on said sensor data in accordance with preset variables.

13. The pump of claim 12 further comprising an exterior housing, said exterior housing being placed over said borehole and containing said monitoring system and read outs derived from said sensor data and said monitoring system.

14. The pump of claim 13 further comprising input means, said input means enabling a user to change at least one of said variables within said program.

15. The pump of claim 12 further comprising a lightning protector, said lightning protector comprising a ground electrode adjacent an electric service riser, a first ground wire, said first ground wire being affixed at a first end to said electrode and at a second end to said exterior housing; a second ground wire, said second ground wire being affixed at a first end to said exterior housing and at a second end to said monitoring computer and a faraday shield.

16. The pump of claim 1 wherein said multiple fluid inlets are along said inlet chamber's periphery proximate said housing.

17. The pump of claim 1 wherein said multiple fluid inlets are along said inlet chamber's periphery opposite said housing.

18. A pump system for removing fluid from boreholes based on the fluid achieving a predetermined level, said pump system having:

a pump, said pump having:

a. an elongated pump housing, said elongated pump housing having an interior, an exterior, a first end and a second end;

b. an inlet chamber, said inlet chamber being adjacent said second end of said pump housing, said inlet chamber having multiple fluid inlets to permit fluid to enter said inlet chamber;

c. a valve system, said valve system extending from said second end of said pump housing into said inlet chamber, said valve system comprising spaced, parallel walls having at least two inline valve seats within said walls, each of said inline valve seats having a open port to enable fluid flow and a check ball, said check ball enabling one way fluid communication between said pump housing and said inlet chamber to enable said fluid to flow from said inlet chamber into said pump housing during a filling mode and preventing said fluid from exiting said pump chamber during a pumping mode;

d. a propellant line, said propellant line having an outlet entering said housing proximate said first end and a compressor connected to an inlet of said propellant line to send propellant into said propellant line;

e. a fluid return line, a first end of said fluid return line extending into said pump housing through said housing first end and second end extending into a fluid storage area;

f. a fluid sensor, said fluid sensor recognizing the presence of said fluid and the absence of said fluid;

g. a slug sensor, said slug sensor being in sensing proximity with said fluid return line to detect the beginning and end of a predetermined quantity of fluid along said fluid return line, a receiver/separator tank, said receiver separator tank separating said fluid from gas contained within said fluid, at least one monitoring system, said monitoring system having a program to read, store and evaluate data obtained from said level sensor and said slug sensor, and activation and deactivation data of said compressor, wherein said system adapts a back up program to activate and deactivate said compressor based on said sensor data in accordance with preset variables, an exterior housing, said exterior housing being placed over said borehole and containing said monitoring system and displaying read outs derived from said sensor data and said monitoring system and having input means, said input means enabling a user to change at least one of said variables within said program, a lightning protector, said lightning protector comprising a ground electrode adjacent an electric service riser, a first ground wire, said first ground wire being affixed at a first end to said electrode and at a second end to said exterior housing, a second ground wire, said second ground wire being affixed at a first end to said exterior housing and at a second end to said monitoring computer and a faraday shield, wherein fluid enters said inlet chamber and is forced by hydrostatic pressure into said pump housing, said fluid rising until said fluid sensor activates said propellant, said propellant forcing said fluid through said fluid return line into said receiver/separator tank to separate said fluid from said gas, said fluid flowing from said receiver/separator tank into said storage area.

19. A shunt valve system for use in lines connected to a pump within a borehole, said shunt valve system being placed inline with, and providing fluid contact between, a propellant supply line leading into said pump and a fluid return line leading out of said pump, said valve having:

a. a valve body, said valve body having a recessed receiving area, an input end and an output end, b. a propellant line channel, said propellant channel being inline with said propellant supply line, c. a fluid return line channel, said fluid return line channel being inline with said fluid return line, d. a connection passage within said recessed receiving area fluidly connecting said propellant line channel and said fluid return line channel, e. a powered cylinder extending into said body adjacent said recessed receiving area and having an input connector and an output connector, f. a compressor hose, said compressor hose having a first end and a second end, said first end being affixed to a compressor and said second end being affixed to said power cylinder input connector, said compressor maintaining a preprogrammed level of pressure, through said hose, g. a valve plate, said valve plate being moveably connected to said valve body and affixed to said powered cylinder, movement of said valve plate enabling or restricting fluid flow through said connection passage, h. a cylinder activation member activating movement of said cylinder in response to borehole pressure, wherein when borehole pressure created by rising fluid within said borehole is greater than said preprogrammed pressure from said compressor, said cylinder activation member activates said cylinder causing said valve plate to move to enable fluid within said propellant line to pass from said propellant line to said fluid return line until pressure within said borehole is less than said preprogrammed pressure, thereby enabling said cylinder to return said valve plate port out of alignment with said passage to block said fluid entry into said passage.

* * * * *